US010421926B2

(12) United States Patent
Man et al.

(10) Patent No.: US 10,421,926 B2
(45) Date of Patent: Sep. 24, 2019

(54) CLEANING AND RINSE AID COMPOSITIONS AND EMULSIONS OR MICROEMULSIONS EMPLOYING OPTIMIZED EXTENDED CHAIN NONIONIC SURFACTANTS

(71) Applicant: Ecolab USA Inc., Saint Paul, MN (US)

(72) Inventors: Victor Fuk-Pong Man, St. Paul, MN (US); Derrick Richard Anderson, Vadnais Heights, MN (US)

(73) Assignee: Ecolab USA Inc., Saint Paul, MN (US)

( * ) Notice: Subject to any disclaimer, the term of this patent is extended or adjusted under 35 U.S.C. 154(b) by 243 days.

(21) Appl. No.: 15/411,050

(22) Filed: Jan. 20, 2017

(65) Prior Publication Data

US 2018/0208876 A1 Jul. 26, 2018

(51) Int. Cl.

| | |
|---|---|
| ***C11D 17/00*** | (2006.01) |
| ***C11D 1/66*** | (2006.01) |
| ***C11D 3/00*** | (2006.01) |
| ***C11D 3/20*** | (2006.01) |
| ***C11D 11/00*** | (2006.01) |
| ***C11D 1/722*** | (2006.01) |
| ***C11D 1/825*** | (2006.01) |
| ***C11D 3/37*** | (2006.01) |

(52) U.S. Cl.

CPC ..... *C11D 1/66* (2013.01); *C11D 1/722* (2013.01); *C11D 1/8255* (2013.01); *C11D 3/0026* (2013.01); *C11D 3/2068* (2013.01); *C11D 3/3707* (2013.01); *C11D 11/0023* (2013.01)

(58) Field of Classification Search

CPC ..... C11D 1/825; C11D 1/83

USPC ..... 510/365, 340, 360, 417

See application file for complete search history.

(56) References Cited

U.S. PATENT DOCUMENTS

| | | | |
|---|---|---|---|
| 3,871,898 | A | 3/1975 | Reinert et al. |
| 4,492,646 | A | 1/1985 | Welch |
| 5,082,584 | A | 1/1992 | Loth et al. |
| 5,376,310 | A | 12/1994 | Cripe et al. |

(Continued)

FOREIGN PATENT DOCUMENTS

| | | | |
|---|---|---|---|
| EP | 368146 | A2 | 5/1990 |
| EP | 573341 | B1 | 7/1998 |

(Continued)

OTHER PUBLICATIONS

Ecolab USA Inc., PCT/US2010/049319, filed Sep. 17, 2010, "International Search Report", dated Jun. 1, 2011, 3 pages.

(Continued)

*Primary Examiner* — Gregory E Webb

(74) *Attorney, Agent, or Firm* — McKee, Voorhees & Sease, PLC

(57) ABSTRACT

The invention discloses synergistic combinations of extended chain surfactants which can form microemulsions without the need for a linker/co-surfactant. In certain embodiments a surfactant system is disclosed which includes extended nonionic surfactants, with an internal PO linker having a chain length of about 5 to 8, may be capped, or include a Guerbet alcohol hydrophobe. This system forms stable emulsions or microemulsions with oils, including non-trans fats proteins, and fatty acids. The invention also includes cleaning compositions, such as hard surface cleaners, warewash detergents, rinse aids and the like which incorporate the same.

41 Claims, 5 Drawing Sheets

(56) References Cited

U.S. PATENT DOCUMENTS

| | | | | |
|---|---|---|---|---|
| 5,393,468 | A | 2/1995 | Erilli et al. | |
| 5,597,507 | A | 1/1997 | Garrett et al. | |
| 5,661,121 | A | 8/1997 | Dahlgren et al. | |
| 5,688,930 | A | 11/1997 | Bertho et al. | |
| 5,707,948 | A | 1/1998 | Evers et al. | |
| 5,780,416 | A | 7/1998 | Kiewert et al. | |
| 5,888,957 | A | 3/1999 | Durbut et al. | |
| 5,994,283 | A | 11/1999 | Durbut et al. | |
| 6,136,769 | A | 10/2000 | Asano et al. | |
| 6,156,712 | A | 12/2000 | Stringer et al. | |
| 6,228,829 | B1 | 5/2001 | Vinson et al. | |
| 6,254,859 | B1 | 7/2001 | Shapiro et al. | |
| 6,274,874 | B1 | 8/2001 | Sidhu | |
| 6,277,808 | B1 | 8/2001 | Tcheou et al. | |
| 6,472,364 | B1 | 10/2002 | Heltovics | |
| 6,511,954 | B1 | 1/2003 | Wilbur et al. | |
| 6,589,926 | B1 | 7/2003 | Vinson et al. | |
| 6,613,726 | B1 | 9/2003 | Gagliardi et al. | |
| 6,740,627 | B1 | 5/2004 | Clarke et al. | |
| 6,827,795 | B1 | 12/2004 | Kasturi et al. | |
| 6,903,064 | B1 * | 6/2005 | Kasturi | C11D 3/0026 424/70.11 |
| 7,037,884 | B2 | 5/2006 | Man | |
| 7,288,512 | B2 | 10/2007 | Boone et al. | |
| 7,371,716 | B2 | 5/2008 | Ruland et al. | |
| 7,419,552 | B2 | 9/2008 | Ruland et al. | |
| 7,467,633 | B2 | 12/2008 | Smith et al. | |
| 8,235,120 | B2 | 8/2012 | Quintero et al. | |
| 8,785,363 | B2 | 7/2014 | Man et al. | |
| 9,303,240 | B2 | 4/2016 | Man et al. | |
| 2001/0026942 | A1 | 10/2001 | Carpenter et al. | |
| 2002/0193268 | A1 | 12/2002 | Embleton et al. | |
| 2003/0087787 | A1 | 5/2003 | Man et al. | |
| 2003/0114341 | A1 | 6/2003 | Liu | |
| 2003/0139313 | A1 | 7/2003 | Turner et al. | |
| 2005/0020466 | A1 | 1/2005 | Man et al. | |
| 2005/0049168 | A1 | 3/2005 | Yan et al. | |
| 2006/0211593 | A1 | 9/2006 | Smith et al. | |
| 2007/0054827 | A1 | 3/2007 | Cheung | |
| 2007/0143032 | A1 | 6/2007 | Wieringa et al. | |
| 2008/0207981 | A1 | 8/2008 | Hoag et al. | |
| 2009/0183877 | A1 | 7/2009 | Quintero et al. | |
| 2009/0208051 | A1 | 8/2009 | Emo et al. | |
| 2009/0223635 | A1 | 9/2009 | Lawless | |
| 2009/0261270 | A1 | 10/2009 | Carling | |
| 2009/0305940 | A1 | 12/2009 | Schimmel et al. | |
| 2010/0234263 | A1 * | 9/2010 | Wasan | B82Y 30/00 510/218 |
| 2011/0112007 | A1 | 5/2011 | Hodge et al. | |
| 2012/0066839 | A1 * | 3/2012 | Man | C11D 1/37 8/137 |
| 2012/0066840 | A1 * | 3/2012 | Man | C11D 1/83 8/137 |
| 2012/0070388 | A1 | 3/2012 | Man et al. | |
| 2012/0071384 | A1 * | 3/2012 | Christensen | C11D 3/43 510/283 |
| 2013/0345111 | A1 | 12/2013 | Kieffer et al. | |
| 2014/0174478 | A1 | 6/2014 | Letzelter et al. | |
| 2016/0090551 | A1 * | 3/2016 | Fossum | C11D 1/16 8/137 |

FOREIGN PATENT DOCUMENTS

| | | | |
|---|---|---|---|
| JP | 63073140 | A | 4/1988 |
| JP | 1100442 | A | 4/1989 |
| JP | 10292199 | A | 11/1998 |
| JP | 2001246339 | | 9/2001 |
| JP | 2009210514 | | 9/2009 |
| WO | 199732962 | A1 | 9/1997 |
| WO | 199927054 | A1 | 6/1999 |
| WO | 200068348 | A1 | 11/2000 |
| WO | 2007064525 | A1 | 6/2007 |
| WO | 2007101470 | A1 | 9/2007 |
| WO | 2010086821 | A2 | 8/2010 |
| WO | 2010105816 | A1 | 9/2010 |
| WO | 2012036701 | A1 | 3/2012 |

OTHER PUBLICATIONS

Ecolab USA Inc., PCT/US2010/049326, filed Sep. 17, 2010, "International Search Report", dated Jun. 1, 2011, 4 pages.
Ecolab USA Inc., PCT/US2010/049334, filed Sep. 17, 2010, "International Search Report", dated Jun. 21, 2011, 3 pages.
Ecolab USA Inc., PCT/US2010/049338, filed Sep. 17, 2010, "International Search Report" dated Jun. 28, 2011, 3 pages.
Barber, J.A.S., et al., "Fluorescent Tracer Technique for Measuring the Quantity of Pesticide Deposited to Soil Following Spray Applications", Crop Protection (2003) 22: pp. 15-21.
Bergervoet, P.W.M., et al., "Application of the Forensic Luminol for Blood in Infection Control", Journal of Hospital Infection (2008) 68: pp. 329-333.
Carling, Philip, et al., "Improved Cleaning of Patient Rooms Using a New Targeting Method", Brief Report, Dept. of Hospital Epidemiology, et al., (2005) pp. 385-388.
Charoensaeng, Ampira, et al., "Solubilization and Adsolubilization of Polar and Nonpolar Organic Solutes by Linker Molecules and Extended Surfactants", J. Surfact. Deterg. (2009) 12: pp. 209-217.
Do, Linh D., et al., "Environmentally Friendly Vegetable Oil Microemulsions Using Extended Surfactants and Linkers", J. Surfact. Deterg. (2009) 12: pp. 91-99.
Griffith, C.J., et al., "An Evaluation of Hospital Cleaning Regimes and Standards", Journal of Hospital Infection (2000) 45: pp. 19-28.
Hartel, Peter G., et al., "Exposing Water Samples to Ultraviolet Light Improves Fluorometry for Detecting Human Fecal Contamination", Water Research (2007) pp. 3629-3642.
Lipscomb, I.P., et al., "Rapid Method for the Sensitive Detection of Protein Contamination on Surgical Instruments", Journal of Hospital Infection (2006) 62: pp. 141-148.
Lu, Y.F., et al., "Laser Surface Cleaning and Real-Time Monitoring", Laser Microprocessing Laboratory, National University of Singapore, (2000) pp. 331-337.
Mori, F., et al., "Equilibrium and Dynamic Behavior of a System Containing a Mixture of Anionic and Nonionic Surfactants", Progr. Colloid Polym. Sci. (1990) vol. 82: pp. 114-121.
Phan, Tri T., et al., "Microemulsion-Based Vegetable Oil Detergency Using an Extended Surfactant", J. Surfact. Deterg. (2010) vol. 13: pp. 313-319.
Pyrek, Kelly, Virgo Publishing, "Hosptials Can Learn from CSI Sleuthing Methods", www.infectioncontroltoday.com, posted Jun. 9, 2008, 1 page.
Salo, Satu, et al., "Cleaning Validation of Fermentation Tanks", Food and Bioproducts Processing (2008) 86: pp. 204-210.
Huntsman Corporation, Technical Bulletin, Surfonic, L24-12 Surfactant, (2007) 2 pages.
Witthayapanyanon, Anuradee, et al., "Interfacial Properties of Extended-Surfactant-Based Microemulsions and Related Macroemulsions", J. Surfact. Deterg. (2010) 13: pp. 127-134.
Zhang, Hui, et al., "Lauryl Alcohol and Amine Oxide as Foam Stabilizers in the Presence of Hardness and Oily Soil", Journal of Surfactants and Detergents, vol. 8, No. 1, (2005), pp. 99-107.
Plurafac® RA 300 Alcohol Alkoxylate, Technical Bulletin, BASF The Chemical Company, 1 page. 2011.

* cited by examiner

CLEANING AND RINSE AID COMPOSITIONS AND EMULSIONS OR MICROEMULSIONS EMPLOYING OPTIMIZED EXTENDED CHAIN NONIONIC SURFACTANTS

FIELD OF THE INVENTION

The invention relates to cleaning compositions and methods of use which employ synergistic combinations of extended chain nonionic surfactants for use in detergent and rinse aid compositions. These optimized extended surfactants have many benefits including the ease of formation of microemulsions, the formation of microemulsions that are non-gelling, have low viscosity and superwetting properties.

BACKGROUND OF THE INVENTION

Surfactants reduce the surface tension of water by adsorbing at the liquid-gas interface. They also reduce the interfacial tension between oil and water by adsorbing at the liquid-liquid interface. Surfactants are a primary component of most detergents and rinse aids. When dissolved in water, surfactants give a product the ability to remove dirt from surfaces. Each surfactant molecule has a hydrophilic head that is attracted to water molecules and a hydrophobic tail that repels water and simultaneously attaches itself to oil and grease in dirt. These opposing forces loosen the dirt and suspend it in the water.

Surfactants do the basic work of detergents and cleaning compositions by breaking up stains and keeping the dirt in the water solution to prevent re-deposition of the dirt onto the surface from which it has just been removed. Surfactants disperse and in some cases, suspend dirt that normally does not dissolve in water and, in the case of rinse aids strip left over grease, allow the suspended dirt to be washed away, and provide wetting and sheeting action to promote faster drying.

Nonylphenol ethoxylates (NPEs) are predominantly used as industrial and domestic detergents as a surfactant. However, while effective, NPEs are disfavored due to environmental concerns. For example, NPEs are formed through the combination of ethylene oxide with nonylphenol (NP). Both NP and NPEs exhibit estrogen-like properties and may contaminate water, vegetation and marine life. NPE is also not readily biodegradable and remains in the environment or food chain for indefinite time periods.

An alternative to NPEs are alcohol ethoxylates (AEs). These alternatives are less toxic and degrade more quickly in the environment. However, it has recently been found that textiles washed with NPE free and phosphorous free detergents containing AEs smoke when exposed to high heat, e.g., in a steam tunnel in industrial laundry processes, or when ironed.

Surfactants are often incorporated in a cleaning composition to clean soiled surfaces. One of the preferred mechanisms is by microemulsifying these soils. Surfactants are also often incorporated into an oil-in-water microemulsion to make oil containing products appear more homogenous. These oil containing products include a variety of different surfactant systems in 5-20% solubilized oil which may be used as is or are then diluted with water prior to use. Examples of these oil containing products include cosmetics products containing oil for skin protection and cleaning products containing oily solvents for degreasing such as terpene and other water immiscible solvents. The surfactant systems generally employed in these cleaning products include a mixture of anionic or non-ionic surfactants and a short chain alcohol to help solubilize the oil phase and prevent liquid crystal formation. While short chain alcohols are effective, they also contribute to the volatile organic solvent content (VOC) of the product and pose flammability problems.

As can be seen there is a continuing need to develop effective, environmentally friendly, and safe surfactants and surfactant systems that can be used in cleaners of all kinds. This is particularly so in light of several new cleaning challenges that have emerged.

Health authorities have recently recommended that trans fats be reduced or eliminated in diets because they present health risks. In response, the food industry has largely replaced the use of trans fats with non-trans fats. These types of non-trans fats are the most difficult to remove from surfaces. The food industry and textile cleaning industry have also experienced an unexplained higher frequency of laundry fires. Textile items such as rags that are not effectively washed to better remove non-trans fats, are prone to cause fire due their substantial heat of polymerization of the trans fats. Non-trans fats have conjugated double bonds that can polymerize and the substantial heat of polymerization involved can cause fire, for example, in a pile of rags used to mop up these non-trans fat soils.

As can be seen, there is a need in the industry for improvement of cleaning compositions, such as hard surface cleaners, rinse aids and laundry detergents and specifically the surfactants used therein so that difficult soils can be removed in a safe environmentally friendly and effective manner.

SUMMARY OF THE INVENTION

The invention meets the needs above by providing surfactant systems, mixtures or blends including optimized extended chain nonionic surfactants. The mixtures form stable microemulsions with oils and fatty acids which can be the resultant product, such as lubricants, sunscreens, or triglyceride based products. The mixtures also improve the ease of formation of microemulsions, as well with resultant microemulsions that are non-gelling, have low viscosity and superwetting properties. These can be used in detergents, rinse aids and the like and form microemulsions without the need for linker or other cosurfactants.

In another embodiment the surfactant system or mixture can be used in a cleaning or rinse aid composition to emulsify, and microemulsify oils and greasy soils, such as non-trans fats and fatty acids, from substrates/surfaces. The surfactant system can be used alone as a pretreatment, or as a part of a cleaning composition such as a laundry detergent, rinse aid, hard surface cleaner or other emulsion or microemulsion.

The invention has many uses and applications, which include but are not limited to laundry cleaning, reduction of laundry fires due to non-trans fats, hard surface cleaning such as manual pot-n-pan cleaning, machine warewashing (pretreatment, detergent or rinse aid), all purpose cleaning, floor cleaning, CIP cleaning, open facility cleaning, foam cleaning, vehicle cleaning, etc. The invention is also relevant to non-cleaning related uses and applications such as dry lubes, tire dressings, polishes, etc. as well as triglyceride based lotions, suntan lotions, potentially pharmaceutical emulsions and microemulsions.

The surfactant mixture of the invention include surfactant systems based on one or more extended chain nonionic surfactants. Notably the surfactants do not need to be combined with linker co-surfactants. This system is highly effective at creating microemulsions with fatty acids and non-trans fats at relatively low temperatures and the use of various surfactants can be modified to form emulsions at different temperatures to allow one to design specific surfactant formations specific to a particular use. The surfactant systems can be used in formulations for laundry detergents, warewash detergents, rinse aids, hard surface cleaners, whether alkali or acid based or even by as a pre-spotting/pre-soaking or rinsing agent.

According to the invention, certain optimized nonionic surfactants can be used as a rinse agent/de-foaming package to provide wetting plus stripping of oil. These surfactants can also form microemulsions without the need of linker cosurfactants. Extended nonionic surfactants include those of the general formula:

$$R\text{-}[L]_x\text{-}[O\text{—}CH_2\text{—}CH_2]_y$$

Where R is the lipophilic moiety, a linear or branched, saturated or unsaturated, substituted or unsubstituted, aliphatic or aromatic hydrocarbon radical having from about 8 to 20 carbon atoms, L is a linking group, or extended hydrophobe such as a block of poly-propylene oxide, a block of poly-ethylene oxide, a block of poly-butylene oxide or a mixture thereof; x is the chain length of the linking group ranging from 5-25; and y is the average degree of ethoxylation ranging from 1-20. Applicant has found that when L is PO the superior extension length is between 5 and 8 moles of PO. In a more preferred embodiment the extended nonionic surfactants include Guerbet alcohol alkoxylates, such as $C_{10}$ Guerbet $(PO)_8EO_x$ where x is 3, 6, 8, or 10) or linear $C_{12\text{-}14}(PO)_{16}(EO)_x$ (x=6, 12, 17). These extended nonionic surfactants reduce or eliminate the need for a cosurfactant when used to form emulsions and microemulsions. Further yet, Applicant has found that capping the extended surfactants, such as with about 1-5 moles of $(R\text{-}[L]_x\text{-}EO_yPO_{(1\text{-}5)})$ or with an alkyl group such as methyl, butyl, benzyl etc. can create stable emulsions with lower foam profiles.

These and other objects, features and attendant advantages of the present invention will become apparent to those skilled in the art from a reading of the following detailed description of the preferred embodiment and the appended claims.

DETAILED DESCRIPTION OF THE INVENTION

Figure 1:
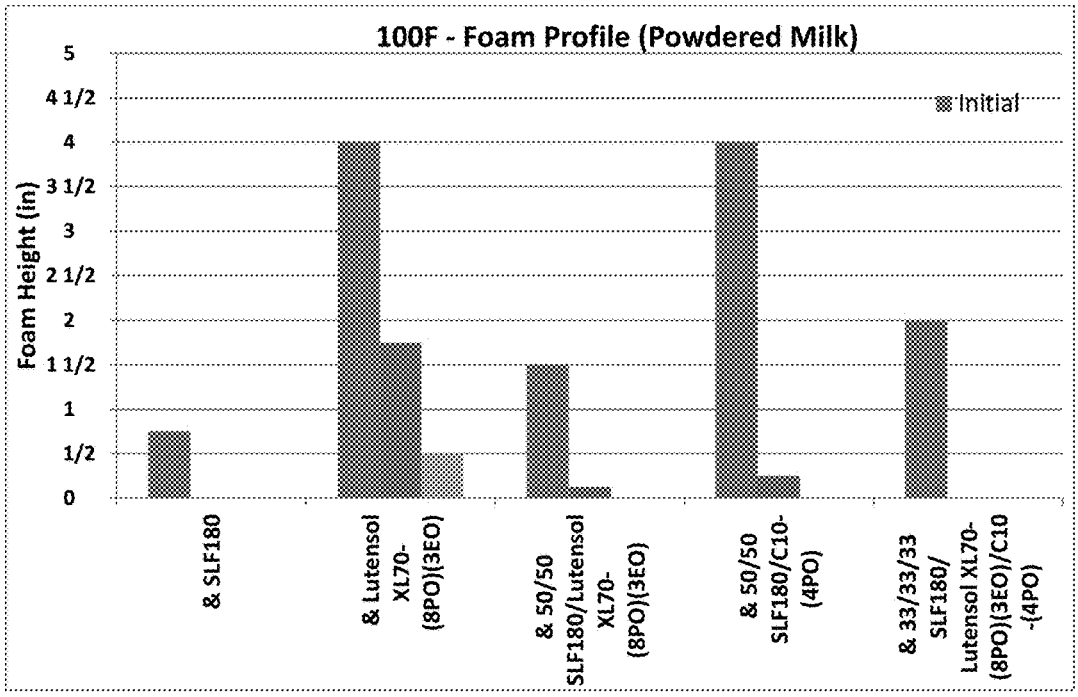
FIG. 1 is a graph showing the foam height profile of various surfactant packages in the presence of food soil (powdered milk).

The embodiments of this invention are not limited to particular applications of use for the inventive surfactant systems, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range (e.g. 1 to 5 includes 1, 1.5, 2, 2.75, 3, 3.80, 4, and 5).

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

An "antiredeposition agent" refers to a compound that helps keep suspended in water instead of redepositing onto the object being cleaned. Antiredeposition agents are useful in the present invention to assist in reducing redepositing of the removed soil onto the surface being cleaned.

As used herein, the term "cleaning" refers to a method used to facilitate or aid in soil removal, bleaching, microbial population reduction, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

As used herein, the term "cleaning composition" includes, unless otherwise indicated, detergent compositions, laundry cleaning compositions, hard surface cleaning compositions, including pretreatments or rinse aids, and personal care cleaning compositions for use in the health and beauty area. Cleaning compositions include granular, powder, liquid, gel, paste, bar form and/or flake type cleaning agents, laundry detergent cleaning agents, laundry soak or spray treatments, fabric treatment compositions, dish washing detergents and soaps, shampoos, body washes and soaps, and other similar cleaning compositions. As used herein, the term "fabric treatment composition" includes, unless otherwise indicated, fabric softening compositions, fabric enhancing compositions, fabric freshening compositions and combinations there of. Such compositions may be, but need not be rinse added compositions.

The term "electrolyte" refers to a substance that will provide ionic conductivity when dissolved in water or when in contact with it; such compounds may either be solid or liquid.

As used herein, the phrase "food processing surface" refers to a surface of a tool, a machine, equipment, a structure, a building, or the like that is employed as part of a food processing, preparation, or storage activity. Examples of food processing surfaces include surfaces of food processing or preparation equipment (e.g., slicing, canning, or transport equipment, including flumes), of food processing wares (e.g., utensils, dishware, wash ware, and bar glasses), and of floors, walls, or fixtures of structures in which food processing occurs. Food processing surfaces are found and employed in food anti-spoilage air circulation systems, aseptic packaging sanitizing, food refrigeration and cooler cleaners and sanitizers, ware washing sanitizing, blancher cleaning and sanitizing, food packaging materials, cutting board additives, third-sink sanitizing, beverage chillers and warmers, meat chilling or scalding waters, autodish sanitizers, sanitizing gels, cooling towers, food processing antimicrobial garment sprays, and non-to-low-aqueous food preparation lubricants, oils, and rinse additives.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, health care surfaces and food processing surfaces, instruments and the like.

The term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated.

Exemplary treated fibers include those treated for flame retardancy. It should be understood that the term "linen" is often used to describe certain types of laundry items including bed sheets, pillow cases, towels, table linen, table cloth, bar mops and uniforms. The invention additionally provides a composition and method for treating non-laundry articles and surfaces including hard surfaces such as dishes, glasses, and other ware.

As used herein, the term "microemulsion" refers to thermodynamically stable, isotropic dispersions consisting of nanometer size domains of water and/or oil stabilized by an interfacial film of surface active agent characterized by ultra low interfacial tension.

As used herein, the term "phosphate-free" refers to a composition, mixture, or ingredient that does not contain a phosphate or phosphate-containing compound or to which a phosphate or phosphate-containing compound has not been added. Should a phosphate or phosphate-containing compound be present through contamination of a phosphate-free composition, mixture, or ingredients, the amount of phosphate shall be less than 0.5 wt %. More preferably, the amount of phosphate is less than 0.1 wt-%, and most preferably, the amount of phosphate is less than 0.01 wt %.

As used herein, the term "phosphorus-free" or "substantially phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt %. More preferably, the amount of phosphorus is less than 0.1 wt-%, and most preferably the amount of phosphorus is less than 0.01 wt %.

As used herein, the term "polymer" generally includes, but is not limited to, homopolymers, copolymers, such as for example, block, graft, random and alternating copolymers, terpolymers, and higher "x"mers, further including their derivatives, combinations, and blends thereof. Furthermore, unless otherwise specifically limited, the term "polymer" shall include all possible isomeric configurations of the molecule, including, but are not limited to isotactic, syndiotactic and random symmetries, and combinations thereof. Furthermore, unless otherwise specifically limited, the term "polymer" shall include all possible geometrical configurations of the molecule.

"Soil" or "stain" refers to a non-polar oily substance which may or may not contain particulate matter such as mineral clays, sand, natural mineral matter, carbon black, graphite, kaolin, environmental dust, etc.

The term "soft surface" refers to a softer, highly flexible material such as fabric, carpet, hair, and skin.

As used herein, the term "soil" or "stain" refers to a non-polar oily substance which may or may not contain particulate matter such as mineral clays, sand, natural mineral matter, carbon black, graphite, kaolin, environmental dust, etc.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

The term "surfactant" as used herein is a compound that contains a lipophilic segment and a hydrophilic segment, which when added to water or solvents, reduces the surface tension of the system. An "extended chain surfactant" is a surfactant having an intermediate polarity linking chain, such as a block of poly-propylene oxide, or a block of poly-ethylene oxide, or a block of poly-butylene oxide or a mixture thereof inserted between the surfactant's conventional lipophilic segment and hydrophilic segment.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polypropylene polymers (PP), polycarbonate polymers (PC), melamine formaldehyde resins or melamine resin (melamine), acrilonitrile-butadiene-styrene polymers (ABS), and polysulfone polymers (PS). Other exemplary plastics that can be cleaned using the compounds and compositions of the invention include polyethylene terephthalate (PET) and polystyrene polyamide.

The term "weight percent," "wt.-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt.-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions. So that the invention maybe more readily understood, certain terms are first defined and certain test methods are described.

Surfactant Systems Employing Optimized Nonionic Extended Chain Surfactants

The surfactant system or mixture of the invention employs one or more extended chain nonionic surfactants. These are surfactants that have an intermediate polarity poly-alkylene oxide chain (or linker) inserted between the lipophilic tail group and hydrophilic polar head, which may be anionic or nonionic.

Examples of lipophilic tail groups include hydrocarbons, alkyl ether, fluorocarbons or siloxanes. Examples of anionic hydrophilic polar heads of the extended surfactant include, but are not necessarily limited to, groups such as sulfate, polyoxyethylene sulfate, ethoxysulfate, carboxylate, ethoxycarboxylate, phosphate, ethoxyphosphates. Examples of nonionic hydrophilic polar heads of the extended surfactant include, but are not necessarily limited to, groups such as polyoxyethylene, C6 sugar, xylitol, di-xylitol, ethoxy-xylitol, and glucose.

Extended surfactants include a linker polyalkylene glycol link.

The general formula for a nonionic extended surfactant is $$R\text{-}[L]_x\text{-}[O\text{—}CH_2\text{—}CH_2]_y$$

where R is the lipophilic moiety, such as a linear or branched, saturated or unsaturated, substituted or unsubstituted, aliphatic or aromatic hydrocarbon radical having from about 8 to 20 carbon atoms, L is a linking group, such as a block of poly-alkylene oxide, preferably polypropylene oxide; x is the chain length of the linking group ranging from 2-25; and y is the average degree of ethoxylation ranging from 1-18. In a preferred embodiment, applicants have found that use of a nonionic surfactant with enough PO extension as the main surfactant (and only) can form liquid single phase microemulsions. PO length is optimized at from about 5 to about 8 moles of PO. This length of PO extension provides a lower foam profile. Applicants have further found that R groups that are a branched hydrophobe such as a guerbet alcohol are better for protein soil defoaming.

Preferred extended surfactants include: branched Guerbet alcohol alkoxylates; such as $C_{10}(PO)_8(EO)_x$ (x=3, 6, 8, 10) also, extended linear alcohol alkoxylates; $C_{(12\text{-}14)}(PO)_{16}(EO)_x$ (x=6, 12, 17).

Branched Alcohol Alkoxylates

Preferred branched alcohol alkoxylates include Guerbet ethoxylates. Guerbet ethoxylates suitable for use according to the invention have the following formula:

$$CH_3(CH_2)_n\underset{\underset{R^1}{|}}{C}HCH_2O(CH_2\underset{\underset{R^1}{|}}{C}HO)_mH$$

In an aspect of the invention the Guerbet ethoxylate is further defined wherein R1 is C2-C20 alkyl and R2 is H or C1-C4 alkyl. In a further aspect of the invention, the Guerbet ethoxylate is defined wherein "n" is an integer between 2 and 20 and wherein "m" is an integer between 1 and 40.

In a preferred aspect of the invention, the branched alcohol alkoxylate is a Guerbet ethoxylate that is prepared from a Guerbet alcohol by dimerization of alkenes (e.g. butane).

The branched alcohol alkoxylates, including Guerbet ethoxylates, can be prepared according to U.S. Pat. Nos. 6,906,320, 6,737,553 and 5,977,048, the disclosure of these patents are herein incorporated by reference in their entirety. Exemplary branched alcohol alkoxylates include those available under the tradenames Lutensol XP-30 and Lutensol XP-50 (BASF Corporation). In general, Lutensol XP-30 can be considered to have 3 repeating ethoxy groups, and Lutensol XP-50 can be considered to have 5 repeating ethoxy groups.

Branched alcohol alkoxylates can be classified as relatively water insoluble or relatively water soluble. In general, a water insoluble branched alcohol alkoxylate can be considered an alkoxylate that, when provided as a composition containing 5 wt.-% of the branched alcohol alkoxylate and 95 wt.-% water, has a tendency to phase separate. Lutensol XP-30 and Lutensol XP-50 from BASF Corporation are examples of water-insoluble branched alcohol alkoxylates.

According to an embodiment of the invention a branched alcohol alkoxylate, preferably a water-insoluble Guerbet ethoxylate has from about 10 wt.-% to about 90 wt.-% ethylene oxide, from about 20 wt.-% to about 70 wt.-% ethylene oxide preferably from about 30 wt.-% to about 60 wt.-% ethylene oxide.

Applicants have further found that use of capped extended nonionic surfactants lowers the foam profile of the composition and foam from protein soil.

Capped extended nonionic surfactants can include:

$$R\text{—}[PO]_x\text{-}[EO]_y[N]z$$

Where N is a capping group such as an alkyl group such as methyl, benzyl, butyl, etc.; a PO group of from 1-5 length, in length. These capped nonionic surfactants have lowered foam profiles and the like are effective for rinse aid formulations and detergents.

These extended chain surfactants attain low tension and/or high solubilization, and can from a single phase microemulsion with oils, such as non-trans fats with additional beneficial properties including, but not necessarily limited to, tunability to temperature and irreversibility within the microemulsion forming temperature range. For example, in one embodiment the emulsions or microemulsions may function over a relatively wide temperature range of from about 80° to 190° C. For example with a PO length of 8, and R as a Guerbet alcohol, extended nonionic surfactants tested according to the invention formed stable microemulsions for 3EO at 90°-80°; 6 EO at 160°-120°; 8EO 150°-185° and 10 EO 165°-190°. Thus one can customize the extended nonionic surfactant for the type of cleaning system used, and at what temperature one wants the micro emulsion to form.

Many extended chain anionic and nonionic surfactants are commercially available from a number of sources. Table 1 is a representative, nonlimiting listing of several examples of the same.

TABLE 1

| Extended Surfactants | Source | % Active | Structure |
|---|---|---|---|
| Plurafac SL-42(nonionic) | BASF | 100 | $C_{6-10}$—$(PO)_3(EO)_6$ |
| Plurafac SL-62(nonionic) | BASF | 100 | $C_{6-10}$—$(PO)_3(EO)_8$ |
| Lutensol XL-40(nonionic) | BASF | 100 | (3 propyl heptanol Guerbet alcohol |
| Lutensol XL-50(nonionic) | BASF | 100 | series) |
| Lutensol XL-60(nonionic) | BASF | 100 | $C_{10}$—$(PO)_a(EO)_b$ series, where a is 1.0 to |
| Lutensol XL-70(nonionic) | BASF | 100 | 1.5, and b is 4 to 14. |
| Lutensol XL-79(nonionic) | BASF | 85 | |
| Lutensol XL-80(nonionic) | BASF | 100 | |
| Lutensol XL-89(nonionic) | BASF | 80 | |
| Lutensol XL-90 (nonionic) | BASF | 100 | |
| Lutensol XL-99 (nonionic) | BASF | 80 | |
| Lutensol XL-100 (nonionic) | BASF | 100 | |
| Lutensol XL-140 (nonionic) | BASF | 100 | |
| New Lutensol XL surfactant designed by Ecolab | BASF | 100 | C10 Guerbet alcohol $(PO)_8(EO)_3$ |
| New Lutensol XL surfactant designed by Ecolab | BASF | 100 | C10 Guerbet alcohol $(PO)_8(EO)_6$ |
| New Lutensol XL surfactant designed by Ecolab | BASF | 100 | C10 Guerbet alcohol $(PO)_8(EO)_8$ |
| New Lutensol XL surfactant designed by Ecolab | BASF | 100 | C10 Guerbet alcohol $(PO)_8(EO)_{10}$ |
| Ecosurf EH-3 (nonionic) | Dow | 100 | 2-Ethyl Hexyl $(PO)_m(EO)_n$ series |
| Ecosurf EH-6 (nonionic) | Dow | 100 | |
| Ecosurf EH-9(nonionic) | Dow | 100 | |
| Ecosurf SA-4(nonionic) | Dow | 100 | $C_{6-12}(PO)_{3-4}(EO)_4$ |
| Ecosurf SA-7 (nonionic) | Dow | 100 | $C_{6-12}(PO)_{3-4}(EO)_7$ |
| Ecosurf SA-9 (nonionic) | Dow | 100 | $C_{6-12}(PO)_{3-4}(EO)_9$ |
| Surfonic PEA-25(nonionic) | Huntsman | 100 | $C_{12-14}(PO)_2N[(EO)_{2.5}\}_2$ |
| X-AES (anionic) | Huntsman | 23 | $C_{12-14}$—$(PO)_{16}$-$(EO)_2$-sulfate |
| X-LAE6 (nonionic) | Huntsman | 100 | $C_{12-14}$—$(PO)_{16}(EO)_6$ |
| X-LAE12 (nonionic) | Huntsman | 100 | $C_{12-14}$—$(PO)_{16}(EO)_{12}$ |
| X-LAE17 (nonionic) | Huntsman | 100 | $C_{12-14}$—$(PO)_{16}(EO)_{17}$ |
| Alfoterra 123-4S (anionic) | Sasol | 30 | $C_{12-13}$—$(PO)_4$-sulfate |
| Alfoterra 123-8S (anionic) | Sasol | 30 | $C_{12-13}$—$(PO)_8$-sulfate |
| Marlowet 4561 (nonionic under acidic condition, anionic under alkaline condition) | Sasol | 90 | $C_{16-18}(PO)_4(EO)_5$-carboxylic acid |
| Marlowet 4560 (nonionic under acidic condition, anionic under alkaline condition) | Sasol | 90 | $C_{16-18}(PO)_4(EO)_2$-carboxylic acid |
| Marlowet 4539 (nonionic under acidic condition, anionic under alkaline condition) | Sasol | 90 | Iso $C_9$—$(PO)_2EO_2$-carboxylic acid |
| LP-6818-41-IP2 | Exp | 100 | $C_{12-14}$—$(PO)_4$ |
| LP-6818-41-IP3 | Exp | 100 | $C_{12-14}$—$(PO)_6$ |
| LP-6818-41-IP4 | Exp | 100 | $C_{12-14}$—$(PO)_8$ |
| LP-6818-47-IP5 | Exp | 100 | $C_{12-14}$—$(PO)_4(EO)_{12}$ |
| LP-6818-47-IP6 | Exp | 100 | $C_{12-14}$—$(PO)_4(EO)_{14}$ |
| LP-6818-47-IP7 | Exp | 100 | $C_{12-14}$—$(PO)_4(EO)_{16}$ |
| LP-6818-49-FB | Exp | 100 | $C_{12-14}$—$(PO)_4(EO)_{18}$ |
| LP-6818-51-IP1 | Exp | 100 | $C_{12-14}$—$(PO)_6(EO)_{14}$ |
| LP-6818-51-IP2 | Exp | 100 | $C_{12-14}$—$(PO)_6(EO)_{16}$ |
| LP-6818-53-IP3 | Exp | 100 | $C_{12-14}$—$(PO)_6(EO)_{18}$ |
| LP-6818-53-FB | Exp | 100 | $C_{12-14}$—$(PO)_6(EO)_{20}$ |
| LP-6818-66-IP2 | Exp | 100 | TDA-$(PO)_4$ |
| LP-6818-67-IP3 | Exp | 100 | TDA-$(PO)_4(EO)_8$ |
| LP-6818-67-IP4 | Exp | 100 | TDA-$(PO)_4(EO)_{10}$ |
| LP-6818-67-IP5 | Exp | 100 | TDA-$(PO)_4(EO)_{12}$ |
| LP-6818-68-IP5 | | | |
| LP-6818-68-IP6 | Exp | 100 | TDA-$(PO)_4(EO)_{14}$ |
| LP-6818-68-FB | Exp | 100 | TDA-$(PO)_4(EO)_{18}$ |
| | Exp | 100 | $C_{12-14}$—$(PO)_{20}(EO)_2$ |

TABLE 1-continued

| Extended Surfactants | Source | % Active | Structure |
|---|---|---|---|
| | Exp | 100 | $C_{12-14}$—$(PO)_{20}(EO)_4$ |
| | Exp | 100 | $C_{12}$—$(PO)_{20}(EO)_6$ |
| Isofol 12 PO5EO5 | Exp | 100 | Guerbet $C_{12}$—$(PO)_5(EO)_5$ |
| Isofol 12 PO5EO8 | Exp | 100 | Guerbet $C_{12}$—$(PO)_5(EO)_8$ |
| Isofol 12 PO8EO5 | Exp | 100 | Guerbet $C_{12}$—$(PO)_8(EO)_5$ |
| Isofol 12 PO8EO8 | Exp | 100 | Guerbet $C_{12}$—$(PO)_8(EO)_8$ |
| Capped | | | |
| Triton DF-12 | DOW | 100 | $C_{8-10}$—$(PO)_2(EO)_{11}$-Benzyl |
| Plurafac SLF-180 | BASF | 100 | C10 Guerbet alcohol $(PO)_3(EO)_{10}(PO)_{10}$ |

** Exp are manufactured by Ecolab

According to the invention, a nonionic extended chain surfactant is employed as a surfactant component in cleaning, rinsing, degreasing, and other formulations. The nonionic surfactants of the invention have been optimized to form stable microemulsions without the need for co-surfactants.

According to the invention, emulsions or microemulsions of different temperature range that are stable and irreversible, i.e. the emulsion or microemulsion does not revert as it stays in the specific temperature range. The surfactant system of the invention is capable of forming emulsions or microemulsions with, or in cleaning compositions for removing or treated stains caused by oils and fatty acids including hydrocarbon type oils, vegetable oils, organic oils, mineral oils, synthetic oils, petrochemical oils, volatile essential oils, including fatty acids, lipids as well as triglycerides.

This feature may be used for removal of the oils in cleaning products or in any other product which requires an oil emulsion or microemulsion such as lubricants, suntan lotions, pharmaceutical applications hair products such as shampoos, gels, conditioners and the like, Petroleum products such as diesel fuel (petrodiesel), ethane (and other short-chain alkanes), fuel oils (heaviest of commercial fuels, used in ships/furnaces), gasoline (petrol), jet fuel, kerosene, and liquefied petroleum gas, Lubrication products for various personal and engineering purposes, detergents, fertilizers, medicines, paints, plastics, synthetic fibers, and synthetic rubber.

Cleaning Compositions Including Rinse Aids Comprising Extended Chain Nonionic Surfactants The surfactant system of the invention may be used alone, as a pre-treatment, pre-soak or pre-spot composition in combination with a traditional warewash, or laundry detergent or cleaner, or may be incorporated within a cleaning composition. The invention comprises both hard surface and soft surface cleaning compositions including the disclosed surfactant system.

Rinse Aid Formulations

In one embodiment, the invention employs the surfactant system of the invention, formulated into a rinse aid including a combination of various surfactants, such as a sheeting agent, a defoaming agent, and one or more of an association disruption agent. The nonionic extended surfactants of the invention can be substituted for any of the components in a traditional rinse aid formulation or used alone.

The compositions of the present invention can be used to reduce spotting and filming on a variety of surfaces including, but not limited to, plasticware, cookware, dishware, flatware, glasses, cups, hard surfaces, glass surfaces, and vehicle surfaces. The compositions of the invention can also be used as wetting agents in a variety of applications, e.g., aseptic packaging/filling.

In some embodiments, the sheeting agent comprises at least one compound having the structure represented by formula I:

$$R—O—(CH_2CH_2O)_n—H \quad (I)$$

wherein R is a ($C_1$-$C_{12}$) alkyl group, and n is an integer in the range of 1 to 100. In other embodiments, n is an integer in the range of 10 to 50. In still yet other embodiments, n is an integer in the range of 15 to 30. In some embodiments, n is 21. According to the invention suitable extended nonionic surfactants that can serve as the sheeting agent include but are not limited to $C_{6-10}$—$(PO)_3(EO)_6$, $C_{10}$—$(PO)_a(EO)_b$ (2 propyl heptanol guerbet alcohol where a is 1-1.5 and b is 4-14), $C_{6-12}(PO)_{3-4}(EO)_7$, $C_{6-12}(PO)_{3-4}(EO)_3$, or the 2 ethylhexyl$(PO)_m(EO)_n$ series available from Dow chemical under the name Ecosurf.

The defoaming agent comprises a polymer compound including one or more ethylene oxide groups. In yet other embodiments, the defoaming agent includes a polyether compound prepared from ethylene oxide, propylene oxide, or a mixture thereof. In still yet other embodiments, the defoaming agent comprises a polyoxypropylene-polyoxyethylene block copolymer surfactant. According to the invention, the extended chain nonionic surfactant can serve as the defoaming agent. In some embodiments the defoaming agent is R—O—$(PO)_y(EO)_x(PO)_z$ where R is C; x=9-22, y=1-4 and z is =10-20 One commercially available example includes Plurafac SLF180.

In some embodiments, the one or more association disruption agent comprises an alcohol alkoxylate. In other embodiments, the association disruption agent is selected from the group consisting of ethylene oxides, propylene oxides, butylene oxides, pentalene oxides, hexylene oxides, heptalene oxides, octalene oxides, nonalene oxides, decylene oxides, and mixtures and derivatives thereof. One example of an association disruption agent includes RA 300 from BASF of the formula R—O-$(EO)_x(PO)_y$—H where R is $C_{10-16}$, x=5.5-7, and y=2-3.5. Extended surfactants, because of the central PO block also serve as an association disruption agent.

The nonionic extended surfactant can comprise the entirety of the rinse aid surfactant formulation or be used in combination with other components. Thus the nonionic extended surfactant can comprise form about 1% to about 99% of the rinse aid formulation according to the invention with the remainder being a carrier.

In some embodiments, the sheeting agent is present at about 1 wt. % to about 10 wt. %. In other embodiments, the sheeting agent is present at about 2 wt. % to about 5 wt. %. In still yet other embodiments, the defoaming agent is present at about 1 wt. % to about 10 wt. %. In still yet other embodiments, the defoaming agent is present at about 2 wt. % to about 5 wt. %.

Sheeting Agents

In some aspects, the rinse aid compositions of the present invention include a sheeting agent. In some embodiments, the sheeting agent includes one or more alcohol ethoxylate compounds that include an alkyl group that has 12 or fewer carbon atoms. For example, alcohol ethoxylate compounds for use in the rinse aids of the present invention may each independently have structure represented by Formula I:

$$R—O—(CH_2CH_2O)_n—H \quad (I)$$

wherein R is a ($C_1$-$C_{12}$) alkyl group and n is an integer in the range of 1 to 100. In some embodiments, R may be a ($C_8$-$C_{12}$) alkyl group, or may be a ($C_8$-$C_{10}$) alkyl group. Similarly, in some embodiments, n is an integer in the range of 10-50, or in the range of 15-30, or in the range of 20-25. In some embodiments, the one or more alcohol ethoxylate compounds are straight chain hydrophobes.

In at least some embodiments, the sheeting agent includes at least two different alcohol ethoxylate compounds each having structure represented by Formula I. That is, the R and/or n variables of Formula I, or both, may be different in the two or more different alcohol ethoxylate compounds present in the sheeting agent. For example, the sheeting agent in some embodiments may include a first alcohol ethoxylate compound in which R is a ($C_8$-$C_{10}$) alkyl group, and a second alcohol ethoxylate compound in which R is a ($C_{10}$-$C_{12}$) alkyl group. In at least some embodiments, the sheeting agent does not include any alcohol ethoxylate compounds that include an alkyl group that has more than 12 carbon atoms. In some embodiments, the sheeting agent includes only alcohol ethoxylate compounds that include an alkyl group that has 12 or fewer carbon atoms.

In some embodiments where, for example, the sheeting agent includes at least two different alcohol ethoxylate compounds, the ratio of the different alcohol ethoxylate compounds can be varied to achieve the desired characteristics of the final composition. For example, in some embodiments including a first alcohol ethoxylate compound and a second alcohol ethoxylate compound, the ratio of weight-percent first alcohol ethoxylate compound to weight-percent second compound may be in the range of about 1:1 to about 10:1 or more. For example, in some embodiments, the sheeting agent can include in the range of about 50% weight percent or more of the first compound, and in the range of about 50 weight percent or less of the second compound, and/or in the range of about 75 weight percent or more of the first compound, and in the range of about 25 weight percent or less of the second compound, and/or in the range of about 85 weight percent or more of the first compound, and in the range of about 15 weight percent or less of the second compound. Similarly, the range of mole ratio of the first compound to the second compound may be about 1:1 to about 10:1, and in some embodiments, in the range of about 3:1 to about 9:1.

In some embodiments, the alcohol ethoxylates used in the sheeting agent can be chosen such that they have certain characteristics, for example, are environmentally friendly, are suitable for use in food service industries, and/or the like. For example, the particular alcohol ethoxylates used in the sheeting agent may meet environmental or food service regulatory requirements, for example, biodegradability requirements.

Some specific examples of suitable sheeting agents that may be used include an alcohol ethoxylate combination including a first alcohol ethoxylate wherein R is a $C_{10}$ alkyl group and n is 21 (i.e. 21 moles ethylene oxide) and a second alcohol ethoxylate wherein R is a $C_{12}$ alkyl group and again, n is 21 (i.e. 21 moles ethylene oxide). Such a combination can be referred to as an alcohol ethoxylate $C_{10-12}$, 21 moles EO. In some particular embodiments, the sheeting agent may include in the range of about 85 wt. % or more of the $C_{10}$ alcohol ethoxylate and about 15 wt. % or less of the $C_{12}$ alcohol ethoxylate. For example, the sheeting agent may include in the range of about 90 wt. % of the $C_{10}$ alcohol ethoxylate and about 10 wt. % of the $C_{12}$ alcohol ethoxylate. One example of such an alcohol ethoxylate mixture is commercially available from Sasol as NOVEL II 1012-21.

In some embodiments, the sheeting agent can be present in the composition from about 1 wt. % to about 10 wt. % of the total composition. In other embodiments, the sheeting agent can be present at from about 2 wt. % to about 5 wt. % of the total composition. For some diluted or use solutions, for example, aqueous use solutions, the sheeting agent can be present at from about 5 ppm to about 250 ppm of the total use solution, about 50 ppm to about 150 ppm of the total use solution, or form about 60 ppm to 100 ppm of the total use solution. It is to be understood that all values and ranges between these values and ranges are encompassed by the present invention.

Defoaming Agent

In some aspects, the rinse aid composition can also include a defoaming agent. The defoaming agent is present at amount effective for reducing the stability of foam that may be created by the sheeting agent in an aqueous solution. The defoaming agent can also contribute to the sheeting performance of the compositions of the present invention. Any of a broad variety of suitable defoamers may be used, for example, any of a broad variety of nonionic ethylene oxide (EO) containing surfactants. Many nonionic ethylene oxide derivative surfactants are water soluble and have cloud points below the intended use temperature of the rinse aid composition, and therefore may be useful defoaming agents.

While not wishing to be bound by theory, it is believed that suitable nonionic EO containing surfactants are hydrophilic and water soluble at relatively low temperatures, for example, temperatures below the temperatures at which the rinse aid will be used. It is theorized that the EO component forms hydrogen bonds with the water molecules, thereby solubilizing the surfactant. However, as the temperature is increased, these hydrogen bonds are weakened, and the EO containing surfactant becomes less soluble, or insoluble in water. At some point, as the temperature is increased, the cloud point is reached, at which point the surfactant precipitates out of solution, and functions as a defoamer. The surfactant can therefore act to defoam the sheeting agent component when used at temperatures at or above this cloud point.

Some examples of ethylene oxide derivative surfactants that may be used as defoamers include polyoxyethylene-polyoxypropylene block copolymers, alcohol alkoxylates, low molecular weight EO containing surfactants, or the like, or derivatives thereof. Some examples of polyoxyethylene-polyoxypropylene block copolymers include those having the following formulae:

$$(EO)x(PO)y(EO)x$$

$$(PO)y(EO)x(PO)y$$

$$(PO)_y(EO)_x(PO)_y(EO)_x(PO)_y$$

-continued

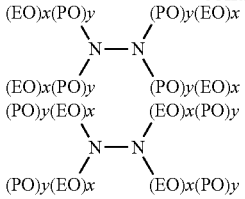

wherein EO represents an ethylene oxide group, PO represents a propylene oxide group, and x and y reflect the average molecular proportion of each alkylene oxide monomer in the overall block copolymer composition. In some embodiments, x is in the range of about 10 to about 130, y is in the range of about 15 to about 70, and x plus y is in the range of about 25 to about 200. It should be understood that each x and y in a molecule can be different. In some embodiments, the total polyoxyethylene component of the block copolymer can be in the range of at least about 20 mol-% of the block copolymer and in some embodiments, in the range of at least about 30 mol-% of the block copolymer. In some embodiments, the material can have a molecular weight greater than about 400, and in some embodiments, greater than about 500. For example, in some embodiments, the material can have a molecular weight in the range of about 500 to about 7000 or more, or in the range of about 950 to about 4000 or more, or in the range of about 1000 to about 3100 or more, or in the range of about 2100 to about 6700 or more.

Although the exemplary polyoxyethylene-polyoxypropylene block copolymer structures provided above have 3-8 blocks, it should be appreciated that the nonionic block copolymer surfactants can include more or less than 3 or 8 blocks. In addition, the nonionic block copolymer surfactants can include additional repeating units such as butylene oxide repeating units. Furthermore, the nonionic block copolymer surfactants that can be used according to the invention can be characterized heteric polyoxyethylene-polyoxypropylene block copolymers. Some examples of suitable block copolymer surfactants include commercial products such as PLURONIC® and TETRONIC® surfactants, commercially available from BASF. For example, PLURONIC® 25-R2 is one example of a useful block copolymer surfactant commercially available from BASF.

The defoamer component can comprise a very broad range of weight percent of the entire composition, depending upon the desired properties. For example, for concentrated embodiments, the defoamer component can comprise in the range of 1 to about 10 wt. % of the total composition, in some embodiments in the range of about 2 to about 5 wt. % of the total composition, in some embodiments in the range of about 20 to about 50 wt. % of the total composition, and in some embodiments in the range of about 40 to about 90 wt. % of the total composition. For some diluted or use solutions, the defoamer component can comprise in the range of 5 to about 60 ppm of the total use solution, in some embodiments in the range of about 50 to about 150 ppm of the total use solution, in some embodiments in the range of about 100 to about 250 ppm of the total use solution, and in some embodiments in the range of about 200 to about 500 ppm of the use solution.

The amount of defoaming agent present in the composition can also be dependent upon the amount of sheeting agent present in the composition. For example, less sheeting agent present in the composition may provide for the use of less defoamer component. In some example embodiments, the ratio of weight-percent sheeting agent component to weight-percent defoamer component may be in the range of about 1:5 to about 5:1, or in the range of about 1:3 to about 3:1. The ratio of sheeting agent component to defoamer component may be dependent on the properties of either and/or both actual components used, and these ratios may vary from the example ranges given to achieve the desired defoaming effect.

Association Disruption Agent

In some aspects, the rinse aid composition can also include one or more of an association disruption agent. Association disruption agents suitable for use in the compositions of the present invention include surfactants that are capable of altering, e.g., interrupting, the association of the other active agents, e.g., sheeting and defoaming agents, included in the rinse aids of the present invention.

In some embodiments, the association disruption agents included in the rinse aid compositions of the present invention reduce the contact angle of the rinse aid compositions. For example, in some embodiments, the association disruption agents reduce the contact angle of the rinse aid compositions by about 5°, about 10°, or by about 15°. Without wishing to be bound by any particular theory, it is thought that the lower the contact angle, the more a composition will induce sheeting. That is, compositions with lower contact angles will form droplets on a substrate with a larger surface area than compositions with higher contact angles. The increased surface area results in a faster drying time, with fewer spots formed on the substrate.

A variety of disruption association agents can be used in the rinse aid compositions of the present invention. In some embodiments, the association disruption agent includes an alcohol alkoxylate. In some embodiments, the alcohol alkoxylate includes a polyoxyethylene-polyoxypropylene copolymer surfactant (an "alcohol EO/PO surfactant"). The alcohol EO/PO surfactant can include a compact alcohol EO/PO surfactant where the EO and PO groups are in small block form, or random form. In other embodiments, the alcohol alkoxylate includes an ethylene oxide, a propylene oxide, a butylene oxide, a pentalene oxide, a hexylene oxide, a heptalene oxide, an octalene oxide, a nonalene oxide, a decylene oxide, and mixtures thereof. In some embodiments, the one or more association disruption agent includes a C12-C14 fatty alcohol EO/PO surfactant.

Exemplary commercially available association disruption agents include, but are not limited to, Genapol EP-2454® (commercially available from Clariant), Plurafac LF-221® (commercially available from BASF), Plurafac LF-500® (commercially available from BASF), and Dehypon® LS-54 (commercially available from Cognis).

In some embodiments, the rinse aid compositions of the present invention include one or more disruption association agent. In other embodiments, the rinse aid compositions of the present invention include at least two, at least three or at least four association disruption agents.

The association disruption agents can be present in the rinse aid compositions at between about 1 wt. % to about 25 wt. %. In some embodiments, the disruption association agent is present in the rinse aid composition at between about 10 wt. % to about 20 wt. %. In other embodiments, the disruption association agent is present in the rinse aid composition at about 15 w %.

In some embodiments the ratio of the sheeting agent, defoaming agent, and association disruption agent is selected so as to maximize the draining/drying time of the rinse aid compositions of the present invention. In some embodiments, the ratio of sheeting agent to defoaming agent to association disrupting agent is from about 1:1.5:30 to about 1:2:1. In some embodiments, the ratio of sheeting agent to defoaming agent to association disrupting agent is about 1:1.6:6.8. It is to be understood that all values and ranges between these values and ranges are encompassed by the present invention.

Cleaning Composition Formulations

In another embodiment the invention includes a ware wash or laundry detergent which includes a builder, and other traditional components such as enzymes. Examples of such standard laundry, warewash and rinse aid components and formulations, which are well known to those skilled in the art, are provided in the following paragraphs.

The detergent or warewash composition can be provided in solid or liquid form and includes, for example, an alkalinity source, a metal protector (for warewash), a surfactant or surfactant system of the invention water, and a threshold agent, and other optional components. Typical formulations can include form about 30% and about 80% by weight alkalinity source, between about 15% and about 35% by weight metal protector, between about 2% and about 10% by weight surfactant, between about 0.1% and about 20% by weight water, between about 0.2% and about 15% by weight threshold agent. If a scale inhibitor is present it is present in an amount of from about 0 to about 15% by weight.

In yet another embodiment, the invention employs hard surface cleaning composition with the surfactant system of the invention, an acid source or source of alkalinity, and optionally a solvent, a water conditioning agent, and water to make a hard surface cleaner which will be effective at removing greasy and oily soils from surfaces such as showers, sinks, toilets, bathtubs, countertops, windows, mirrors, transportation vehicles, floors, and the like.

These surfaces can be those typified as "hard surfaces" (such as walls, floors, bed-pans).

A typical hard surface formulation at about 18% activity includes between about 40 wt. % and about 80 wt. % surfactant system of the invention, between about 3 wt. % and about 18 wt. % water conditioning agent, between about 0.1 wt. % and about 0.55 wt. % acid or alkalinitysource, between about 0 wt. % and about 10 wt. % solvent and between about 10 wt. % and about 60 wt. % water.

Particularly, the cleaning compositions include between about 45 wt. % and about 75 wt. % surfactant system of the invention, between about 0 wt. % and about 10 wt. % optional co-surfactant, between about 5 wt. % and about 15 wt. % water conditioning agent, between about 0.3 wt. % and about 0.5 wt. % acid or alkalinity source, between about 0 and about 6 wt. % solvent and between about 15 wt. % and about 50 wt. % water. In other embodiments, similar intermediate concentrations and use concentrations may also be present in the cleaning compositions of the invention.

Additional Components

While not essential for the purposes of the present invention, the non-limiting list of additional components illustrated hereinafter are suitable for use in the instant compositions and may be desirably incorporated in certain embodiments of the invention, for example to assist or enhance cleaning performance, for treatment of the substrate to be cleaned, or to modify the aesthetics of the cleaning composition as is the case with perfumes, colorants, dyes or the like. The precise nature of these additional components, and levels of incorporation thereof, will depend on the physical form of the composition and the nature of the cleaning operation for which it is to be used. Suitable additional materials include, but are not limited to, surfactants, builders, chelating agents, dye transfer inhibiting agents, viscosity modifiers, dispersants, additional enzymes, and enzyme stabilizers, catalytic materials, bleaches, bleach activators, hydrogen peroxide, sources of hydrogen peroxide, preformed peracids, polymeric dispersing agents, threshold inhibitors for hard water precipitation pigments, clay soil removal/anti-redeposition agents, brighteners, suds suppressors, dyes, fabric hueing agents, perfumes, structure elasticizing agents, fabric softeners, carriers, hydrotropes, processing aids, solvents, pigments antimicrobials, pH buffers, processing aids, active fluorescent whitening ingredient, additional surfactants and mixtures thereof. In addition to the disclosure below, suitable examples of such other adjuncts and levels of use are found in U.S. Pat. Nos. 5,576,282, 6,306,812 B1 and 6,326,348 B1 that are incorporated by reference.

As stated, the adjunct ingredients are not essential to Applicants' compositions. Thus, certain embodiments of Applicants' compositions do not contain additional materials. However, when one or more additional materials are present, such one or more additional components may be present as detailed below:

The liquid detergent herein has a neat pH of from about 7 to about 13, or about 7 to about 9, or from about 7.2 to about 8.5, or from about 7.4 to about 8.2. The detergent may contain a buffer and/or a pH-adjusting agent, including inorganic and/or organic alkalinity sources and acidifying agents such as water-soluble alkali metal, and/or alkali earth metal salts of hydroxides, oxides, carbonates, bicarbonates, borates, silicates, phosphates, and/or metasilicates; or sodium hydroxide, potassium hydroxide, pyrophosphate, orthophosphate, polyphosphate, and/or phosphonate. The organic alkalinity source herein includes a primary, secondary, and/or tertiary amine. The inorganic acidifying agent herein includes HF, HCl, HBr, HI, boric acid, sulfuric acid, phosphoric acid, and/or sulphonic acid; or boric acid. The organic acidifying agent herein includes substituted and substituted, branched, linear and/or cyclic $C_{1-30}$ carboxylic acid.

Bleaching Agents—The cleaning compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the compositions of the present invention may comprise from about 0.1% to about 50% or even from about 0.1% to about 25% bleaching agent by weight of the subject cleaning composition. Examples of suitable bleaching agents include: (1) preformed peracids: Suitable preformed peracids include, but are not limited to, compounds selected from the group consisting of percarboxylic acids and salts, percarbonic acids and salts, perimidic acids and salts, peroxymonosulfuric acids and salts, for example, Oxzone®, and mixtures thereof. Suitable percarboxylic acids include hydrophobic and hydrophilic peracids having the formula R—(C—O)O—O-M wherein R is an alkyl group, optionally branched, having, when the peracid is hydrophobic, from 6 to 14 carbon atoms, or from 8 to 12 carbon atoms and, when the peracid is hydrophilic, less than 6 carbon atoms or even less than 4 carbon atoms; and M is a counterion, for example, sodium, potassium or hydrogen; (2) sources of hydrogen peroxide, for example, inorganic perhydrate salts, including alkali metal salts such as sodium salts of perborate (usually mono- or tetra-hydrate), percarbonate, persulphate, perphosphate, persilicate salts and mixtures thereof. In one aspect of the invention the inorganic perhydrate salts are selected from the group consisting of sodium salts of perborate, percarbonate and mixtures thereof. When employed, inorganic perhydrate salts are typically present in amounts of from 0.05 to 40 wt %, or 1 to 30 wt % of the overall composition and are typically incorporated into such compositions as a crystalline solid that may be coated. Suitable coatings include, inorganic salts such as alkali metal silicate, carbonate or borate salts or mixtures thereof, or organic materials such as water-soluble or dispersible polymers, waxes, oils or fatty soaps; and (3) bleach activators having R—(C—O)-L wherein R is an alkyl group, optionally branched, having, when the bleach activator is hydrophobic, from 6 to 14 carbon atoms, or from 8 to 12 carbon atoms and, when the bleach activator is hydrophilic, less than 6 carbon atoms or even less than 4 carbon atoms; and L is leaving group. Examples of suitable leaving groups are benzoic acid and derivatives thereof—especially benzene sulphonate. Suitable bleach activators include dodecanoyl oxybenzene sulphonate, decanoyl oxybenzene sulphonate, decanoyl oxybenzoic acid or salts thereof, 3,5,5-trimethyl hexanoyloxybenzene sulphonate, tetraacetyl ethylene diamine (TAED) and nonanoyloxybenzene sulphonate (NOBS). Suitable bleach activators are also disclosed in WO 98/17767. While any suitable bleach activator may be employed, in one aspect of the invention the subject cleaning composition may comprise NOBS, TAED or mixtures thereof.

When present, the peracid and/or bleach activator is generally present in the composition in an amount of from about 0.1 to about 60 wt %, from about 0.5 to about 40 wt % or even from about 0.6 to about 10 wt % based on the composition. One or more hydrophobic peracids or precursors thereof may be used in combination with one or more hydrophilic peracid or precursor thereof.

The amounts of hydrogen peroxide source and peracid or bleach activator may be selected such that the molar ratio of available oxygen (from the peroxide source) to peracid is from 1:1 to 35:1, or even 2:1 to 10:1.

Additional Surfactant—In some embodiments, the compositions of the invention include one or more additional surfactants. Additional surfactants can be anionic, nonionic, cationic zwitterionic and can also include additional extended chain surfactant as discussed herein.

The cleaning composition can contain an anionic surfactant component that includes a detersive amount of an anionic surfactant or a mixture of anionic surfactants. In certain embodiments the anionic surfactant can be an extended anionic surfactant. In some instances, the invention can further include an extended anionic surfactant. Anionic extended surfactants generally have the formula $$R\text{-}[L]_x\text{-}[O\text{—}CH_2\text{—}CH_2]_y\text{-}M$$

where M is any ionic species such as carboxylates, sulfonates, sulfates, and phosphates. A cationic species will generally also be present for charge neutrality such as hydrogen, an alkali metal, alkaline earth metal, ammonium and ammonium ions which may be substituted with one or more organic groups.

Anionic surfactants are desirable in cleaning compositions because of their wetting and detersive properties. The anionic surfactants that can be used according to the invention include any anionic surfactant available in the cleaning industry. Suitable groups of anionic surfactants include sulfonates and sulfates. Suitable surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Suitable alkyl aryl sulfonates that can be used in the cleaning composition can have an alkyl group that contains 6 to 24 carbon atoms and the aryl group can be at least one of benzene, toluene, and xylene. A suitable alkyl aryl sulfonate includes linear alkyl benzene sulfonate. A suitable linear alkyl benzene sulfonate includes linear dodecyl benzyl sulfonate that can be provided as an acid that is neutralized to form the sulfonate. Additional suitable alkyl aryl sulfonates include xylene sulfonate and cumene sulfonate.

Suitable alkane sulfonates that can be used in the cleaning composition can have an alkane group having 6 to 24 carbon atoms. Suitable alkane sulfonates that can be used include secondary alkane sulfonates. A suitable secondary alkane sulfonate includes sodium $C_{14}$-$C_{17}$ secondary alkyl sulfonate commercially available as Hostapur SAS from Clariant.

Suitable alkyl methyl ester sulfonates that can be used in the cleaning composition include those having an alkyl group containing 6 to 24 carbon atoms. Suitable alpha olefin sulfonates that can be used in the cleaning composition include those having alpha olefin groups containing 6 to 24 carbon atoms.

Suitable alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. A suitable alkoxy group is ethoxy. A suitable alkyl ether sulfate is sodium lauryl ether sulfate and is available under the name Steol CS-460.

Suitable alkyl sulfates that can be used in the cleaning composition include those having an alkyl group containing 6 to 24 carbon atoms. Suitable alkyl sulfates include, but are not limited to, sodium lauryl sulfate and sodium lauryl/myristyl sulfate.

Suitable alcohol sulfates that can be used in the cleaning composition include those having an alcohol group containing about 6 to about 24 carbon atoms.

The anionic surfactant can be neutralized with an alkaline metal salt, an amine, or a mixture thereof. Suitable alkaline metal salts include sodium, potassium, and magnesium. Suitable amines include monoethanolamine, triethanolamine, and monoisopropanolamine. If a mixture of salts is used, a suitable mixture of alkaline metal salt can be sodium and magnesium, and the molar ratio of sodium to magnesium can be between about 3:1 and about 1:1.

The cleaning composition, when provided as a concentrate, can include the additional anionic surfactant component in an amount sufficient to provide a use composition having desired wetting and detersive properties after dilution with water. The concentrate can contain about 0.1 wt. % to about 0.5 wt. %, about 0.1 wt. % to about 1.0 wt. %, about 1.0 wt. % to about 5 wt. %, about 5 wt. % to about 10 wt. %, about 10 wt. % to about 20 wt. %, 30 wt. %, about 0.5 wt. % to about 25 wt. %, and about 1 wt. % to about 15 wt. %, and similar intermediate concentrations of the anionic surfactant.

The cleaning composition can contain a nonionic surfactant component that includes a detersive amount of nonionic surfactant or a mixture of nonionic surfactants. Nonionic surfactants can be included in the cleaning composition to enhance grease removal properties. Although the surfactant component can include a nonionic surfactant component, it should be understood that the nonionic surfactant component can be excluded from the detergent composition.

Additional nonionic surfactants that can be used in the composition include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants include a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. A suitable average molecular weight range of useful surfactants can be about 1,000 to about 40,000 and the weight percent content of ethylene oxide can be about 10-80 wt %.

Other nonionic surfactants include alcohol alkoxylates. An suitable alcohol alkoxylate include linear alcohol ethoxylates such as Tomadol™ 1-5 which is a surfactant containing an alkyl group having 11 carbon atoms and 5 moles of ethylene oxide. Additional alcohol alkoxylates include alkylphenol ethoxylates, branched alcohol ethoxylates, secondary alcohol ethoxylates (e.g., Tergitol 15-S-7 from Dow Chemical), castor oil ethoxylates, alkylamine ethoxylates, tallow amine ethoxylates, fatty acid ethoxylates, sorbital oleate ethoxylates, end-capped ethoxylates, or mixtures thereof. Additional nonionic surfactants include amides such as fatty alkanolamides, alkyldiethanolamides, coconut diethanolamide, lauric diethanolamide, polyethylene glycol cocoamide (e.g., PEG-6 cocoamide), oleic diethanolamide, or mixtures thereof. Additional suitable nonionic surfactants include polyalkoxylated aliphatic base, polyalkoxylated amide, glycol esters, glycerol esters, amine oxides, phosphate esters, alcohol phosphate, fatty triglycerides, fatty triglyceride esters, alkyl ether phosphate, alkyl esters, alkyl phenol ethoxylate phosphate esters, alkyl polysaccharides, block copolymers, alkyl polyglucosides, or mixtures thereof.

When nonionic surfactants are included in the detergent composition concentrate, they can be included in an amount of at least about 0.1 wt. % and can be included in an amount of up to about 15 wt. %. The concentrate can include about 0.1 to 1.0 wt. %, about 0.5 wt. % to about 12 wt. % or about 2 wt. % to about 10 wt. % of the nonionic surfactant.

Amphoteric surfactants can also be used to provide desired detersive properties. Suitable amphoteric surfactants that can be used include, but are not limited to: betaines, imidazolines, and propionates. Suitable amphoteric surfactants include, but are not limited to: sultaines, amphopropionates, amphodipropionates, aminopropionates, aminodipropionates, amphoacetates, amphodiacetates, and amphohydroxypropylsulfonates.

When the detergent composition includes an amphoteric surfactant, the amphoteric surfactant can be included in an amount of about 0.1 wt % to about 15 wt %. The concentrate can include about 0.1 wt % to about 1.0 wt %, 0.5 wt % to about 12 wt % or about 2 wt % to about 10 wt % of the amphoteric surfactant.

The cleaning composition can contain a cationic surfactant component that includes a detersive amount of cationic surfactant or a mixture of cationic surfactants. Cationic co-surfactants that can be used in the cleaning composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride.

Builders—The cleaning compositions of the present invention may comprise one or more detergent builders or builder systems. When a builder is used, the subject composition will typically comprise at least about 1%, from about 5% to about 60% or even from about 10% to about 40% builder by weight of the subject composition. The detergent may contain an inorganic or organic detergent builder which counteracts the effects of calcium, or other ion, water hardness. Examples include the alkali metal citrates, succinates, malonates, carboxymethyl succinates, carboxylates, polycarboxylates and polyacetyl carboxylate; or sodium, potassium and lithium salts of oxydisuccinic acid, mellitic acid, benzene polycarboxylic acids, and citric acid; or citric acid and citrate salts. Organic phosphonate type sequestering agents such as DEQUEST® by Monsanto and alkanehydroxy phosphonates are useful. Other organic builders include higher molecular weight polymers and copolymers, e.g., polyacrylic acid, polymaleic acid, and polyacrylic/polymaleic acid copolymers and their salts, such as SOKALAN® by BASF. Generally, the builder may be up to 30%, or from about 1% to about 20%, or from abut 3% to about 10%.

The compositions may also contain from about 0.01% to about 10%, or from about 2% to about 7%, or from about 3% to about 5% of a $C_{8-20}$ fatty acid as a builder. The fatty acid can also contain from about 1 to about 10 EO units. Suitable fatty acids are saturated and/or unsaturated and can be obtained from natural sources such a plant or animal esters (e.g., palm kernel oil, palm oil, coconut oil, babassu oil, safflower oil, tall oil, tallow and fish oils, grease, and mixtures thereof), or synthetically prepared (e.g., via the oxidation of petroleum or by hydrogenation of carbon monoxide via the Fisher Tropsch process). Useful fatty acids are saturated $C_{12}$ fatty acid, saturated $C_{12-14}$ fatty acids, saturated or unsaturated $C_{12-18}$ fatty acids, and a mixture thereof. Examples of suitable saturated fatty acids include captic, lauric, myristic, palmitic, stearic, arachidic and behenic acid. Suitable unsaturated fatty acids include: palmitoleic, oleic, linoleic, linolenic and ricinoleic acid.

Chelating Agents—The cleaning compositions herein may contain a chelating agent. Suitable chelating agents include copper, iron and/or manganese chelating agents and mixtures thereof. When a chelating agent is used, the subject composition may comprise from about 0.005% to about 15% or even from about 3.0% to about 10% chelating agent by weight of the subject composition.

Dye Transfer Inhibiting Agents—The cleaning compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in a subject composition, the dye transfer inhibiting agents may be present at levels from about 0.0001% to about 10%, from about 0.01% to about 5% or even from about 0.1% to about 3% by weight of the composition.

Optical Brighteners—In some embodiments, an optical brightener component, may be present in the compositions of the present invention. The optical brightener can include any brightener that is capable of eliminating graying and yellowing of fabrics. Typically, these substances attach to the fibers and bring about a brightening and simulated bleaching action by converting invisible ultraviolet radiation into visible longer-wave length light, the ultraviolet light absorbed from sunlight being irradiated as a pale bluish fluorescence and, together with the yellow shade of the grayed or yellowed laundry, producing pure white.

Fluorescent compounds belonging to the optical brightener family are typically aromatic or aromatic heterocyclic materials often containing condensed ring systems. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.).

Optical brighteners useful in the present invention are known and commercially available. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene. In an embodiment, optical brighteners include stilbene derivatives.

In some embodiments, the optical brightener includes Tinopal UNPA, which is commercially available through the Ciba Geigy Corporation located in Switzerland.

Additional optical brighteners for use in the present invention include, but are not limited to, the classes of substance of 4,4'-diamino-2,2'-stilbenedisulfonic acids (flavonic acids), 4,4'-distyrylbiphenyls, methylumbelliferones, coumarins, dihydroquinolinones, 1,3-diarylpyrazolines, naphthalimides, benzoxazol, benzisoxazol and benzimidazol systems, and pyrene derivatives substituted by heterocycles, and the like. Suitable optical brightener levels include lower levels of from about 0.01, from about 0.05, from about 0.1 or even from about 0.2 wt % to upper levels of 0.5 or even 0.75 wt %.

Dispersants—The compositions of the present invention can also contain dispersants. Suitable water-soluble organic materials include the homo- or co-polymeric acids or their salts, in which the polycarboxylic acid comprises at least two carboxyl radicals separated from each other by not more than two carbon atoms.

Enzymes—The cleaning compositions can comprise one or more enzymes which provide cleaning performance and/or fabric care benefits. Enzymes can be included herein for a wide variety of fabric laundering purposes, including removal of protein-based, carbohydrate-based, or triglyceride-based stains, for example, and/or for fabric restoration. Examples of suitable enzymes include, but are not limited to, hemicellulases, peroxidases, proteases, cellulases, xylanases, lipases, phospholipases, esterases, cutinases, pectinases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, or combinations thereof and may be of any suitable origin. The choice of enzyme(s) takes into account factors such as pH-activity, stability optima, thermostability, stability versus active detergents, chelants, builders, etc. A detersive enzyme mixture useful herein is a protease, lipase, cutinase and/or cellulase in conjunction with amylase. Sample detersive enzymes are described in U.S. Pat. No. 6,579,839.

Enzymes are normally present at up to about 5 mg, more typically from about 0.01 mg to about 3 mg by weight of active enzyme per gram of the detergent. Stated another way, the detergent herein will typically contain from about 0.001% to about 5%, or from about 0.01% to about 2%, or from about 0.05% to about 1% by weight of a commercial enzyme preparation. Protease enzymes are present at from about 0.005 to about 0.1 AU of activity per gram of detergent. Proteases useful herein include those like subtilisins from *Bacillus* [e.g. *subtilis, lentus, licheniformis, amyloliquefaciens* (BPN, BPN'), *alcalophilus*,] e.g. Esperase®, Alcalase®, Everlase® and Savinase® (Novozymes), BLAP and variants (Henkel). Further proteases are described in EP 130756, WO 91/06637, WO 95/10591 and WO 99/20726.

Amylases are described in GB Pat. #1 296 839, WO 94/02597 and WO 96/23873; and available as Purafect Ox Am® (Genencor), Termamyl®, Natalase®, Ban®, Fungamyl®, Duramyl® (all Novozymes), and RAPIDASE (International Bio-Synthetics, Inc).

The cellulase herein includes bacterial and/or fungal cellulases with a pH optimum between 5 and 9.5. Suitable cellulases are disclosed in U.S. Pat. No. 4,435,307 to Barbesgoard, et al., issued Mar. 6, 1984. Cellulases useful herein include bacterial or fungal cellulases, e.g. produced by *Humicola insolens*, particularly DSM 1800, e.g. 50 kD and ~43 kD (Carezyyme®). Additional suitable cellulases are the EGIII cellulases from *Trichoderma longibrachiatum*. WO 02/099091 by Novozymes describes an enzyme exhibiting endo-beta-glucanase activity (EC 3.2.1.4) endogenous to *Bacillus* sp., DSM 12648; for use in detergent and textile applications; and an anti-redeposition endo-glucanase in WO 04/053039. Kao's EP 265 832 describes alkaline cellulase K, CMCase I and CMCase II isolated from a culture product of *Bacillus* sp KSM-635. Kao further describes in EP 1 350 843 (KSM S237; 1139; KSM 64; KSM N131), EP 265 832A (KSM 635, FERM BP 1485) and EP 0 271 044 A (KSM 534, FERM BP 1508; KSM 539, FERM BP 1509; KSM 577, FERM BP 1510; KSM 521, FERM BP 1507; KSM 580, FERM BP 1511; KSM 588, FERM BP 1513; KSM 597, FERM BP 1514; KSM 522, FERM BP 1512; KSM 3445, FERM BP 1506; KSM 425. FERM BP 1505) readily-mass producible and high activity alkaline cellulases/endo-glucanases for an alkaline environment. Such endo-glucanase may contain a polypeptide (or variant thereof) endogenous to one of the above *Bacillus* species. Other suitable cellulases are Family 44 Glycosyl Hydrolase enzymes exhibiting endo-beta-1,4-glucanase activity from *Paenibacilus polyxyma* (wild-type) such as XYG1006 described in WO 01/062903 or variants thereof. Carbohydrases useful herein include e.g. mannanase (see, e.g., U.S. Pat. No. 6,060,299), pectate lyase (see, e.g., WO99/27083), cyclomaltodextrin glucanotransferase (see, e.g., WO96/33267), and/or xyloglucanase (see, e.g., WO99/02663). Bleaching enzymes useful herein with enhancers include e.g. peroxidases, laccases, oxygenases, lipoxygenase (see, e.g., WO 95/26393), and/or (non-heme) haloperoxidases.

Suitable endoglucanases include: 1) An enzyme exhibiting endo-beta-1,4-glucanase activity (E.C. 3.2.1.4), with a sequence at least 90%, or at least 94%, or at least 97% or at least 99%, or 100% identity to the amino acid sequence of positions 1-773 of SEQ ID NO:2 in WO 02/099091; or a fragment thereof that has endo-beta-1,4-glucanase activity. GAP in the GCG program determines identity using a GAP creation penalty of 3.0 and GAP extension penalty of 0.1. See WO 02/099091 by Novozymes A/S on Dec. 12, 2002, e.g., Celluclean™ by Novozymes A/S. GCG refers to sequence analysis software package (Accelrys, San Diego, Calif., USA). GCG includes a program called GAP which uses the Needleman and Wunsch algorithm to find the alignment of two complete sequences that maximizes the number of matches and minimizes the number of gaps; and 2) Alkaline endoglucanase enzymes described in EP 1 350 843A published by Kao on Oct. 8, 2003 ([0011]-[0039] and examples 1-4).

Suitable lipases include those produced by *Pseudomonas* and *Chromobacter*, and LIPOLASE®, LIPOLASE ULTRA®, LIPOPRIME® and LIPEX® from Novozymes. See also Japanese Patent Application 53-20487, laid open on Feb. 24, 1978, available from Areario Pharmaceutical Co. Ltd., Nagoya, Japan, under the trade name Lipase P "Amano". Other commercial lipases include Amano-CES, lipases ex *Chromobacter viscosum*, available from Toyo Jozo Co., Tagata, Japan; and *Chromobacter viscosum* lipases from U.S. Biochemical Corp., U.S.A. and Diosynth Co., The Netherlands, and lipases ex *Pseudomonas gladioli*. Also suitable are cutinases [EC 3.1.1.50] and esterases.

Enzymes useful for liquid detergent formulations, and their incorporation into such formulations, are disclosed in U.S. Pat. No. 4,261,868 to Hora, et al., issued Apr. 14, 1981. In an embodiment, the liquid composition herein is substantially free of (i.e. contains no measurable amount of) wild-type protease enzymes. A typical combination is an enzyme cocktail that may comprise, for example, a protease and lipase in conjunction with amylase. When present in a cleaning composition, the aforementioned additional enzymes may be present at levels from about 0.00001% to about 2%, from about 0.0001% to about 1% or even from about 0.001% to about 0.5% enzyme protein by weight of the composition.

Enzyme Stabilizers—Enzymes for use in detergents can be stabilized by various techniques. The enzymes employed herein can be stabilized by the presence of water-soluble sources of calcium and/or magnesium ions in the finished compositions that provide such ions to the enzymes. In case of aqueous compositions comprising protease, a reversible protease inhibitor, such as a boron compound, can be added to further improve stability.

A useful enzyme stabilizer system is a calcium and/or magnesium compound, boron compounds and substituted boric acids, aromatic borate esters, peptides and peptide derivatives, polyols, low molecular weight carboxylates, relatively hydrophobic organic compounds [e.g. certain esters, diakyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl) serine salts; (meth) acrylic acid-(meth)acrylic acid ester copolymer and PEG; lignin compound, polyamide oligomer, glycolic acid or its salts; poly hexa methylene bi guanide or N,N-bis-3-aminopropyl-dodecyl amine or salt; and mixtures thereof. The detergent may contain a reversible protease inhibitor e.g., peptide or protein type, or a modified subtilisin inhibitor of family VI and the plasminostrepin; leupeptin, peptide trifluoromethyl ketone, or a peptide aldehyde. Enzyme stabilizers are present from about 1 to about 30, or from about 2 to about 20, or from about 5 to about 15, or from about 8 to about 12, millimoles of stabilizer ions per liter.

Catalytic Metal Complexes—Applicants' cleaning compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. Nos. 5,597,936; 5,595,967. Such cobalt catalysts are readily prepared by known procedures, such as taught for example in U.S. Pat. Nos. 5,597,936, and 5,595,967.

Compositions herein may also suitably include a transition metal complex of ligands such as bispidones (WO 05/042532 A1) and/or macropolycyclic rigid ligands—abbreviated as "MRLs". As a practical matter, and not by way of limitation, the compositions and processes herein can be adjusted to provide on the order of at least one part per hundred million of the active MRL species in the aqueous washing medium, and will typically provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include, for example, manganese, iron and chromium. Suitable MRLs include 5,12-diethyl-1,5,8,12-tetraazabicyclo[6.6.2]hexadecane.

Suitable transition metal MRLs are readily prepared by known procedures, such as taught for example in WO 00/32601, and U.S. Pat. No. 6,225,464.

Solvents—Suitable solvents include water and other solvents such as lipophilic fluids. Examples of suitable lipophilic fluids include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof. In some embodiments, the solvent includes water. The water can include water from any source including deionized water, tap water, softened water, and combinations thereof. Solvents are typically present at from about 0.1% to about 50%, or from about 0.5% to about 35%, or from about 1% to about 15% by weight.

Form of the Compositions

The cleaning/rinse aid compositions of the present invention may be of any suitable form, including paste, liquid, solid (such as tablets, powder/granules), foam or gel, with powders and tablets being preferred. The composition may be in the form of a unit dose product, i.e. a form which is designed to be used as a single portion of detergent composition in a washing operation. Of course, one or more of such single portions may be used in a cleaning operation.

Solid forms include, for example, in the form of a tablet, rod, ball or lozenge. The composition may be a particulate form, loose or pressed to shape or may be formed by injection moulding or by casting or by extrusion. The composition may be encased in a water soluble wrapping, for, example of PVOH or a cellulosic material. The solid product may be provided as a portioned product as desired.

The composition may also be in paste, gel or liquid form, including unit dose (portioned products) products. Examples include a paste, gel or liquid product at least partially surrounded by, and preferably substantially enclosed in a water-soluble coating, such as a polyvinyl alcohol package. This package may for instance take the form of a capsule, a pouch or a moulded casing (such as an injection moulded casing) etc. Preferably the composition is substantially surrounded by such a package, most preferably totally surrounded by such a package. Any such package may contain one or more product formats as referred to herein and the package may contain one or more compartments as desired, for example two, three or four compartments.

If the composition is a foam, a liquid or a gel it is preferably an aqueous composition although any suitable solvent may be used. According to an especially preferred embodiment of the present invention the composition is in the form of a tablet, most especially a tablet made from compressed particulate material.

If the compositions are in the form of a viscous liquid or gel they preferably have a viscosity of at least 50 mPas when measured with a Brookfield RV Viscometer at 25° C. with Spindle 1 at 30 rpm.

The compositions of the invention will typically be used by placing them in a detergent dispenser e.g. in a dishwasher machine draw or free standing dispensing device in an automatic dishwashing machine, laundry machine etc. However, if the composition is in the form of a foam, liquid or gel then it may be applied to by any additional suitable means into the dishwashing machine, for example by a trigger spray, squeeze bottle or an aerosol.

Processes of Making Cleaning Compositions/Rinse Aids

The compositions of the invention may be made by any suitable method depending upon their format. Suitable manufacturing methods for detergent compositions are well known in the art, non-limiting examples of which are described in U.S. Pat. Nos. 5,879,584; 5,691,297; 5,574,005; 5,569,645; 5,565,422; 5,516,448; 5,489,392; and 5,486,303. Various techniques for forming detergent compositions in solid forms are also well known in the art, for example, detergent tablets may be made by compacting granular/particular material and may be used herein.

In one aspect, the liquid detergent compositions disclosed herein may be prepared by combining the components thereof in any convenient order and by mixing, e.g., agitating, the resulting component combination to form a phase stable liquid detergent composition. In one aspect, a liquid matrix is formed containing at least a major proportion, or even substantially all, of the liquid components, with the liquid components being thoroughly admixed by imparting shear agitation to this liquid combination. For example, rapid stirring with a mechanical stirrer may usefully be employed. While shear agitation is maintained, substantially all of any anionic surfactant and the solid ingredients can be added. Agitation of the mixture is continued, and if necessary, can be increased at this point to form a solution or a uniform dispersion of insoluble solid phase particulates within the liquid phase. After some or all of the solid-form materials have been added to this agitated mixture, particles of any enzyme material to be included, e.g., enzyme prills are incorporated. As a variation of the composition preparation procedure described above, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

Solid formulations may be made advantageously by pressing the solid composition. Specifically, in a forming process, the liquid and solid components are introduced into the final mixing system and are continuously mixed until the components form a substantially homogeneous semi-solid mixture in which the components are distributed throughout its mass. In an exemplary embodiment, the components are mixed in the mixing system for at least approximately 5 seconds. The mixture is then discharged from the mixing system into, or through, a die, press or other shaping means. The product is then packaged. In an exemplary embodiment, the solid formed composition begins to harden between approximately 1 minute and approximately 3 hours. Particularly, the formed composition begins to harden in between approximately 1 minute and approximately 2 hours. More particularly, the formed composition begins to harden in between approximately 1 minute and approximately 20 minutes.

In yet another embodiment, a single- or twin-screw extruder may be used to combine and mix one or more components agents at high shear to form a homogeneous mixture. In some embodiments, the processing temperature is at or below the melting temperature of the components. The processed mixture may be dispensed from the mixer by pressing, forming, extruding or other suitable means, whereupon the composition hardens to a solid form. The structure of the matrix may be characterized according to its hardness, melting point, material distribution, crystal structure, and other like properties according to known methods in the art. Generally, a solid composition processed according to the method of the invention is substantially homogeneous with regard to the distribution of ingredients throughout its mass and is dimensionally stable.

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques. All references cited herein are hereby incorporated in their entirety by reference.

EXAMPLES

Example 1

Importance of PO Chain Length in Micro Emulsion Formation

Preferred extended nonionic surfactants are branched hydrophobes for better stacking in interfaces, lower pour points and lower interfacial viscoelasticity. Previous work with extended anionic surfactants, has indicated that about 5-8 PO units are necessary for micro emulsion formation with triglyceride oils. We tested a series of Guerbet alcohol extended surfactants $(PO)_8$ $(EO)_x$, where x varies to give a range of cloud points for different temperature applications. These are labeled as Extended AE 2-5, their exact structures in tables herein.

(1) Micro-Emulsion Study (vs. Soybean Oil) with Nonionic Extended Surfactants Without the Need for a Co-surfactant

TABLE 1

Nonionic Extended Surfactants micro emulsion formation (no co-surfactant)

| | Base Structure | PO | EO | Micro emulsion |
|---|---|---|---|---|
| Plurafac SLF-180 | C6-10(yPO)(xEO)(ZPO) | 1.5 | | No |
| Triton DF12 | $C_{8-10}$—$(PO)_2(EO)_{11}$-Benzyl | 2 | 11 | No |
| Lutensol XL-40 | Guerbet Alcohol | 1.5 | 4 | NO |
| EcoSurf EH-3 | Ethylhexyl Alcohol | 2 | 3 | NO |
| Plurafac SL 42 | Guerbet Alcohol | 3 | 6 | NO |
| Extended AE 1 | Linear C12-14 Alcohol | 4 | 12 | NO |
| Extended AE 2 | Guerbet Alcohol | 8 | 3 | YES |
| Extended AE 3 | Guerbet Alcohol | 8 | 6 | YES |
| Extended AE 4 | Guerbet Alcohol | 8 | 8 | YES |
| Extended AE 5 | Guerbet Alcohol | 8 | 10 | YES |

TABLE 1-continued

Nonionic Extended Surfactants micro emulsion formation (no co-surfactant)

| | Base Structure | PO | EO | Micro emulsion |
|---|---|---|---|---|
| Extended AE 6 | Linear C12-14 Alcohol | 16 | 6 | YES |
| Extended AE 7 | Linear C12-14 Alcohol | 16 | 12 | YES |
| Extended AE 8 | Linear C12-14 Alcohol | 16 | 17 | YES |

Most of the extended surfactants studied are not capped, except for Plurafac SLF-180 which is capped with a few moles of PO, and Triton DF12, which is benzyl capped. Table 1 shows the importance of propoxylation for single surfactant systems to form microemulsion with triglyceride oils. Having the correct number of PO makes micro emulsion formation possible. We have established that the optimal # of PO is about 5-8. These actually represents a breakthrough development in extended non-ionic surfactants as for the first time we can form triglycerides based Winsor Phase IV microemulsions without the need of a co-surfactant.

TABLE 2

Cloud point of Extended Guerbet alcohol alkoxylates with 8 moles PO

| | PO mols | EO mols | 1% Cloud C. | F. |
|---|---|---|---|---|
| Extended AE 2 | 8 | 3 | 15.6 | 60 |
| Extended AE 3 | 8 | 6 | 47.8 | 118 |
| Extended AE 4 | 8 | 8 | 67.1 | 153 |
| Extended AE 5 | 8 | 10 | 81.1 | 178 |

TABLE 3

Microemulsion of Extended Guerbet alcohol alkoxylates with 8 moles PO

| | Exp 1 | Exp 2 | Exp 3 | Exp 4 | Exp 5 | Exp 6 | Exp 7 | Exp 8 | Exp 9 | Exp 10 | Exp 11 | Exp 12 |
|---|---|---|---|---|---|---|---|---|---|---|---|---|
| Soybean Oil | 5 | 5 | 5 | 5 | 5 | 5 | 5 | 5 | 5 | 5 | 5 | 5 |
| Water | 5 | 5 | 5 | 5 | 5 | 5 | 5 | 5 | 5 | 5 | 5 | 5 |
| Extended AE 2 | 3 | 4 | 5 | | | | | | | | | |
| Extended AE 3 | | | | 3 | 4 | 5 | | | | | | |
| Extended AE 4 | | | | | | | 3 | 4 | 5 | | | |
| Extended AE 5 | | | | | | | | | | 3 | 4 | 5 |
| Microemulsion Temp | | 90-80 | 90-80 | 160-138 | 160-120 | 160-120 | | 180-150 | 185-140 | | 190-170 | 190-165 |

Example 2

Application in Machine Warewash Detergent

TABLE 4

Foam Height of Extended Alkoxylated Ethers
Glewwe Foam Height
100 ppm Chemistry, 6 psi

| Extended alcohol alkoxylate 2 (PO)8(EO)3 | | | | Extended alcohol alkoxylate 3 (PO)8(EO)6 | | | |
|---|---|---|---|---|---|---|---|
| | Initial | 15 sec | 60 sec | | Initial | 15 sec | 60 sec |
| RT | 1.5 | ¼ | ¼ | RT | 5 | 4 | 2 |
| 100 F. | 1 | ¼ | ¼ | 125 F. | 4.5 | 3 | 1.5 |
| 115 F. | ¼ | 0 | 0 | 150 F. | ½ | ⅛ | ⅛ |

TABLE 5

Food Soil Defoaming Profile of Extended Surfactants

Glewwe Defoam Evaluation with Powdered Milk:
Glewwe foam apparatus was set at 6 psi for 5 minutes at varied temperatures (° F.). The machine was then shut off and foam was measured for 1 minute. Test run in soft water.

Materials Used:
3 L soft water; 20 g powdered milk (Favorite Brand); 50 ppm active in the Glewwe

| Product | Temp (° F.) | Rinse Aid grams used | Avtives level | Surfactant Foam Profile after 1 min run time (inches) Initial | 15 sec | 1 min | Powdered Milk Protein Soil after 5 (total) mins run time Initial | 15 sec | 1 min | |
|---|---|---|---|---|---|---|---|---|---|---|
| 25R2 | 120 | 0.15 | 100.0% | 0 | 0 | 0 | 1 | 0 | 0 | |
| 25R2 | 140 | 0.15 | 100.0% | 0 | 0 | 0 | 1¼ | 0 | 0 | |
| 25R2 | 160 | 0.15 | 100.0% | 0 | 0 | 0 | 3 | 1 | 0 | |
| SLF 180 L#0008433051 | 120 | 0.15 | 100.0% | 0 | 0 | 0 | trace | 0 | 0 | Extended |
| SLF 180 L#0008433051 | 160 | 0.15 | 100.0% | 0 | 0 | 0 | 3 | 0 | 0 | Surfactants |
| Guerbet $(PO)_8(EO)_3$ | 120 | 0.15 | 100.0% | 0 | 0 | 0 | 4 | ½ | ¼ | |
| Guerbet $(PO)_8(EO)_3$ | 140 | 0.15 | 100.0% | 0 | 0 | 0 | 3 | ¼ | ¼ | |
| Guerbet $(PO)_8(EO)_3$ | 160 | 0.15 | 100.0% | 0 | 0 | 0 | 2¼ | ¼ | ¼ | |
| Guerbet $(PO)_8(EO)_6$ | 120 | 0.15 | 100.0% | 3 | 2 | 1 | | | | |
| Guerbet $(PO)_8(EO)_6$ | 140 | 0.15 | 100.0% | 1 | ½ | ¼ | | | | |
| Guerbet $(PO)_8(EO)_6$ | 160 | 0.15 | 100.0% | ¼ | trace | trace | 6 | 5 | 3 | |
| Linear C12-14 $(PO)_{16}(EO)_8$ | 120 | 0.15 | 100.0% | 0 | 0 | 0 | 3½ | 2¼ | ½ | |
| Linear C12-14 $(PO)_{16}(EO)_8$ | 140 | 0.15 | 100.0% | 0 | 0 | 0 | 3½ | 2 | ½ | |
| Linear C12-14 $(PO)_{16}(EO)_8$ | 160 | 0.15 | 100.0% | 0 | 0 | 0 | 3½ | 2¼ | ½ | |
| Ethyl Hexyl (Ecosurf EH-3) | 120 | 0.15 | 100.0% | ¼ | 0 | 0 | | | | |
| Ethyl Hexvl (Ecosurf EH-3) | 140 | 0.15 | 100.0% | ¼ | 0 | 0 | | | | |
| Ethyl Hexyl (Ecosurf EH-3) | 160 | 0.15 | 100.0% | ¼ | 0 | 0 | 8 | 6½ | 2½ | |

| Product (50 ppm SLF-180) + (50 ppm extended) | Temp (° F.) | Rinse Aid grams used | Avtives level | Surfactant Foam Profile after 1 min run time (inches) initial | 15 sec | 1 min | Powdered Milk Protein Soil after 5 (total) minutes run time initial | 15 sec | 1 min |
|---|---|---|---|---|---|---|---|---|---|
| Plurafac SLF-180 | 75 | 0.15 | 100.0% | 3½ | 1 | ⅛ | 4½ | 2 | ¼ |
| | 100 | 0.15 | 100.0% | ½ | 0 | 0 | trace | 0 | 0 |
| | 120 | 0.15 | 100.0% | trace | 0 | 0 | ½ | 0 | 0 |
| | 160 | 0.15 | 100.0% | trace | 0 | 0 | 3 | 0 | 0 |
| 50/50 SLF180 + LP-6818-41-IP4 | 75 | 0.15 | 100.0% | ½ | 0 | 0 | 1 | 0 | 0 |
| | 100 | 0.15 | 100.0% | 0 | 0 | 0 | ½ | 0 | 0 |
| | 120 | 0.15 | 100.0% | 0 | 0 | 0 | ½ | 0 | 0 |
| | 160 | 0.15 | 100.0% | 0 | 0 | 0 | 1 | 0 | 0 |
| 50/50 SLF180 + LP-6818-41-IP2 | 75 | 0.15 | 100.0% | ½ | 0 | 0 | 1 | 0 | 0 |
| | 100 | 0.15 | 100.0% | 0 | 0 | 0 | 1 | 0 | 0 |
| | 120 | 0.15 | 100.0% | 0 | 0 | 0 | 1 | 0 | 0 |
| | 160 | 0.15 | 100.0% | 0 | 0 | 0 | 2 | 0 | 0 |
| 50/50 SLF180 + LP-6818-66-IP2 | 75 | 0.15 | 100.0% | ½ | 0 | 0 | 1 | 0 | 0 |
| | 100 | 0.15 | 100.0% | 0 | 0 | 0 | 1 | 0 | 0 |
| | 120 | 0.15 | 100.0% | 0 | 0 | 0 | 1½ | 0 | 0 |
| | 160 | 0.15 | 100.0% | 0 | 0 | 0 | 2¼ | 0 | 0 |
| 50/50 SLF180 + Decyl Alcohol | 75 | 0.15 | 100.0% | 1½ | 0 | 0 | 2½ | ¼ | 0 |
| | 100 | 0.15 | 100.0% | 0 | 0 | 0 | 1½ | 0 | 0 |
| | 120 | 0.15 | 100.0% | 0 | 0 | 0 | 2 | 0 | 0 |
| | 160 | 0.15 | 100.0% | 0 | 0 | 0 | 3½ | ¼ | 0 |
| 50/50 SLF180 + Triton-DF12 | 75 | 0.15 | 100.0% | 2 | 0 | 0 | 4¾ | 1½ | ¼ |
| | 100 | 0.15 | 100.0% | 0 | 0 | 0 | 1 | 0 | 0 |
| | 120 | 0.15 | 100.0% | 0 | 0 | 0 | 1 | 0 | 0 |
| | 160 | 0.15 | 100.0% | 0 | 0 | 0 | 1 | 0 | 0 |

Plurifac SLF-180 is a low foaming alcohol alkoxylate from BASF C6-10(yPO)(xEO)(ZPO) 1.5 PO and a PO cap.
Pluronic 25R2 is an ethylene oxide/propylene oxide black copolymer from BASF.

FIG. 1 shows the foam profile of surfactant packages in the presence of food soil. Once can see that capping the extended nonionic surfactant can lead to a lower foam profile.

Summary:

PO capped extended surfactant, Plurafac SLF-180, is superior to reverse block copolymer, (EO)(PO) Pluronic 25R2, in protein soil defoaming.

The middle PO extension in the extended Guerbet ethoxylates does lower their foam profile and provides some protein soil defoaming above their cloud points. However, they maybe even more effective if capped with a few moles of PO, and/or capped with an alkyl group such as methyl, butyl, etc.

Guerbet alcohol $(PO)_8(EO)_6$ forms micro emulsion at 120-160 F and Guerbet alcohol $(PO)_8(EO)_8$ forms micro emulsion at 140-180 F, making them excellent degreaser for machine warewash. However, they may also be made The comparison between Guerbet alcohol $(PO)_8$ ethoxylates and linear $C_{12-14}(PO)_{16}$ ethoxylates illustrates that a branched hydrophobe is better for protein soil defoaming and the excess PO in the extension does not contribute further.

Example 3

Application in Rinse Aid

Figure 2:
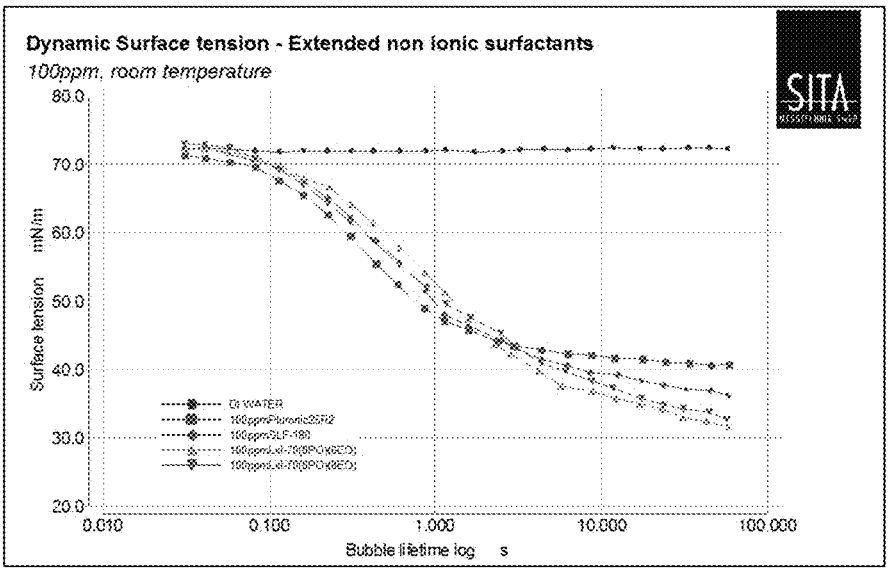
FIG. 2 is a graph showing dynamic surface tension comparison of traditional non-ionic surfactants and extended alkoxylated non-ionic surfactants.

FIG. 2 shows the dynamic surface tension comparison of tradition non-ionic surfactants and extended alkoxylated non-ionic surfactants.

| | Hysteresis |
|---|---|
| DIWater | 23.76 |
| 100 ppm 25R2 | 4.79 |
| 100 ppm SLF-180 | 4.745 |
| 100 ppm (8PO)6(EO) Guerbet | 2.54 |

Figure 3:
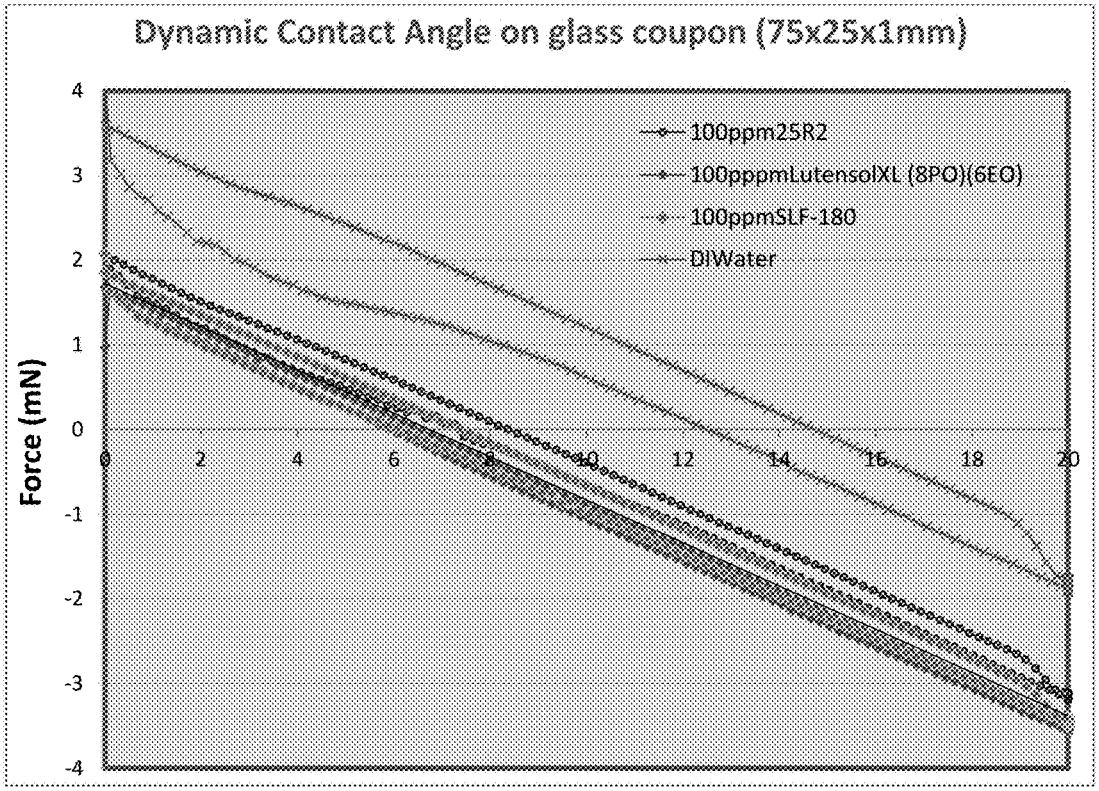
FIG. 3 is a graph showing dynamic contact angle on clean glass surface showing the hysteresis of different surfactants.

Hysteresis is a measure of dynamic advancing and receding contact angle (wetting). The C10 Guerbet shows better wetting and less difference between advancing and receding surface tension (better and more consistent wetting). FIG. 3 shows the dynamic contact angle on clean glass surface showing the hysteresis of different surfactants.

Figure 4:
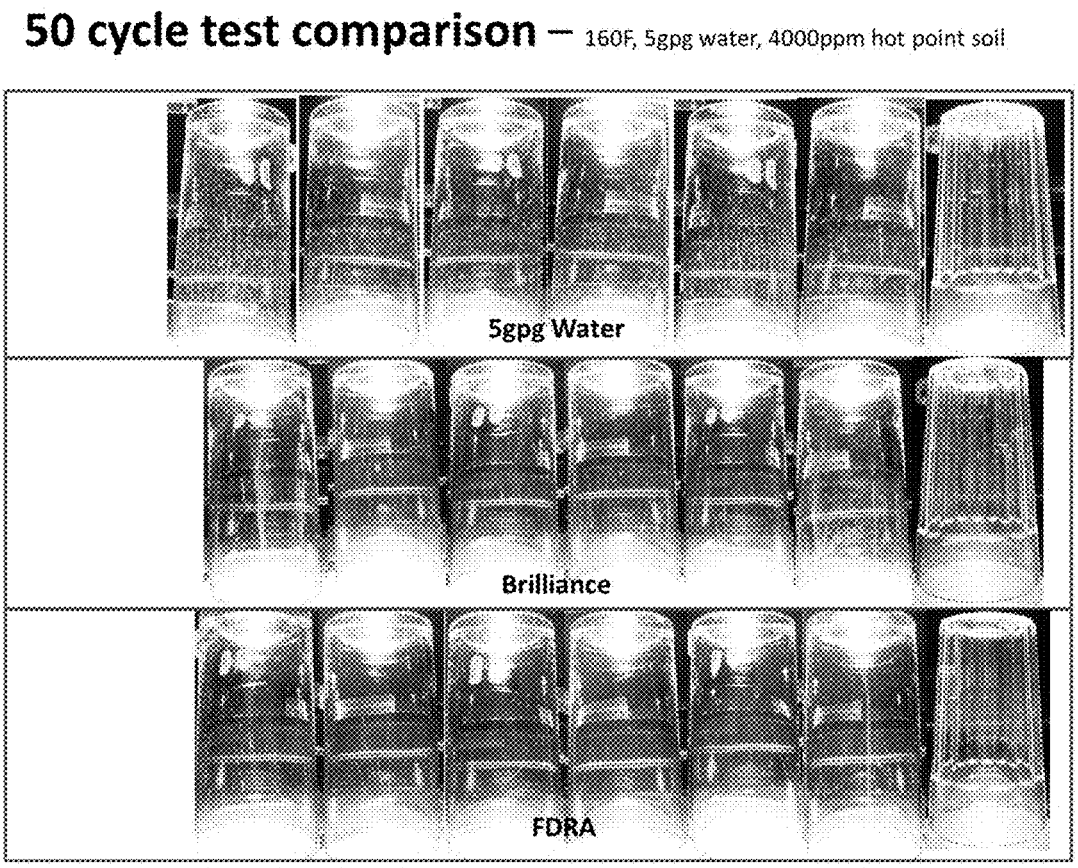
FIG. 4 is a photograph showing the results of a 50 cycle warewash test comparing spot/film of various surfactant packages.

FIG. 4 shows the results of a warewash 50 cycle test comparing spot/film of various surfactant packages.

Figure 5:
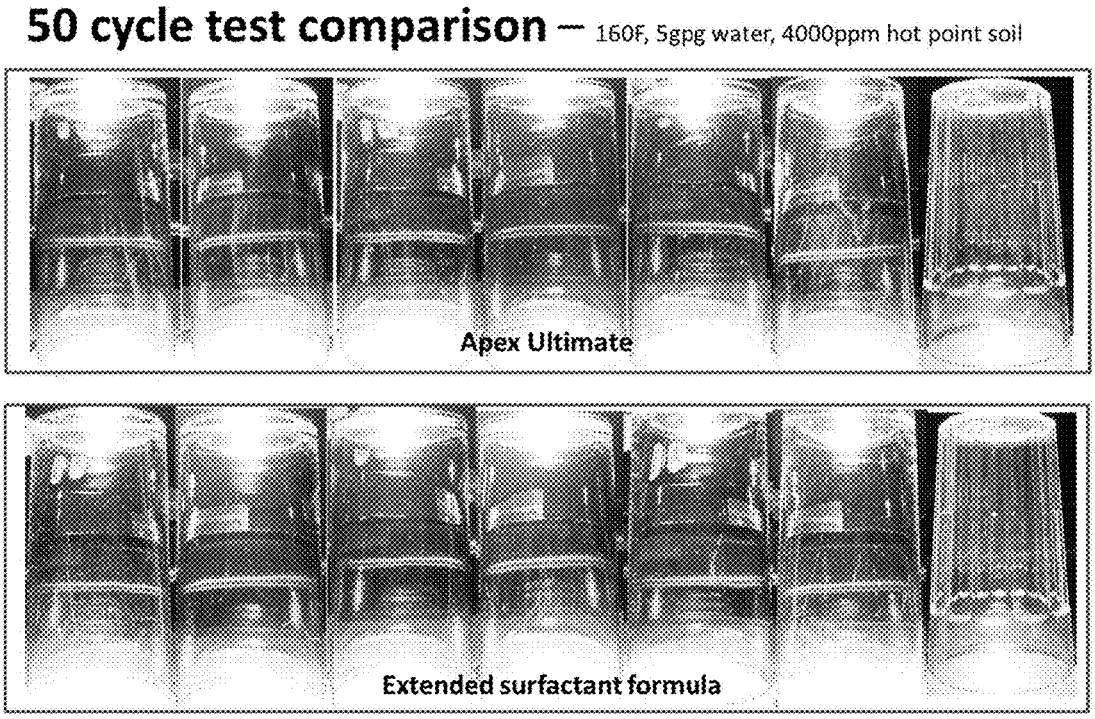
FIG. 5 is a photograph showing the results of a 50 cycle warewash test of the extended surfactant package of the invention and traditional rinse surfactant package.
Figure 6:
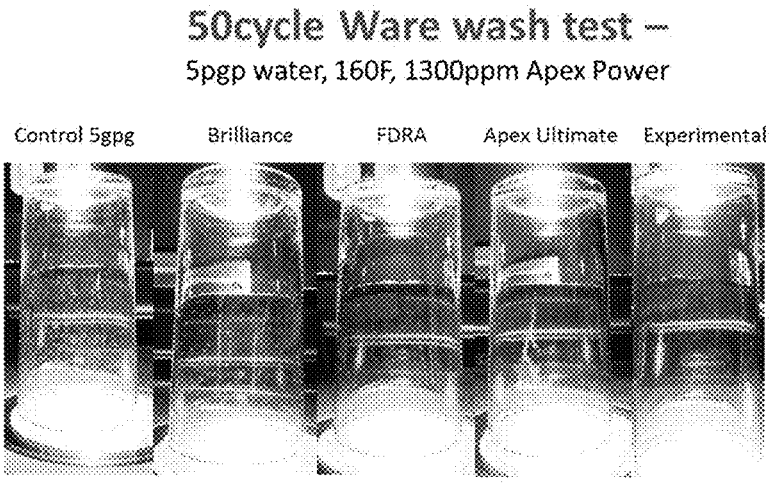
FIG. 6 is a photograph showing the warewash results summary.

FIG. 5 shows the results of a warewash 50 cycle test of various surfactant packages. Extended surfactant package and traditional rinse surfactant package.

FIG. 1 shows the Warewash test results summary.

Conclusions, and Aspects and Embodiments of the Invention:

- The results show that an extended surfactant is critical for micro emulsion formation with triglyceride oil.
- A certain length of extension (moles of PO in the middle) is necessary. One of the most important finding is establishing that the required extension length is somewhere between 5 and 8 moles PO.
- Nonionic extended surfactants: Guerbet alcohol alkoxylates; C10(PO)8(EO)x (x=3, 6, 8, 10) also, extended linear alcohol alkoxylates; C12-14(PO)16(EO)x (x=6, 12, 17), reduce the dependency of a co-surfactant is critical and unique.
- Because of the strong hydrogen bonding of the anionic charge group (worst for more water loving groups such as sulfate). It is very difficult, if not impossible, to form a liquid emulsion of equal portion active water/anionic surfactant/triglyceride. We have overcome such obstacle with the use of long enough PO extension on the anionic surfactant, greatly minimizing the formation of paste. The PO extension increases fluidity and greatly reduces interfacial viscoelasticity. The viscoelasticity reducing effect is enhanced with the further combination with novel co-surfactants.
- The use of a nonionic surfactant with enough PO extension as the main surfactant (and only) can form liquid single phase microemulsions. These extended surfactants: Guerbet alcohol alkoxylates; C10(PO)8(EO)x (x=3, 6, 8, 10) also, extended linear alcohol alkoxylates; C12-14(PO)16(EO)x (x=6, 12, 17) are effective in forming microemulsions with oily soils, even the tough to "microemulsify" non-transfats such as fresh and used soybean oils, facilitating their eventual removal from a substrate. These compositions are also expected to provide ultra-low interfacial tensions with oils and be useful in the Energy applications such as Enhanced Oil Recovery.
- The use of extended nonionic surfactants is very efficient in forming microemulsions with non-trans fat oils.

Example 4

Further Rinse Aid Development

TABLE 6

Comparison of recent rinse aid development.

| | Commercial rinse Aid | More recent rinse aid | Extended surfactant based (example of this invention) | Extended surfactant based (another example of invention) |
|---|---|---|---|---|
| Sheeting agents | Novel II | TDA-6 and TDA-3 | SL-42 and XL-40. A second alternative combo is SA-7 and SA-3. A third alternative combo is EH-6 and EH-3. | Greater than 3 moles of PO (Guerbet C10 and linear C12) |
| Association disruption agents | LF-221, LF-500, and EP 2454 | RA 300 | Choose from RA 300, LF-221, LF-500, and EP-2454. | optional |
| Defoaming agent | 25R2 | SLF 180 | SLF 180 | optional |

NOVELII is a $C_{10}$ alcohol ethoxylate to $C_{12}$ alcohol ethoxylate mixture commercially available from Sasol as NOVEL II 1012-21.
LF-221, LF-500 and EO2454 are compact alcohol ethoxylates (EO)(PO).
Plurafac RA300 $R^1$—O—$(EO)_{x3}(PO)_{y3}$—H where C10-C16, $x_3$ = 5.5-7, $y_3$ = 2-3.5
Dehyphon LS54 $R^1$—O—$(EO)_{x4}(PO)_{y4}$—H where C10-C16, $x_4$ = 4-5.5, $y_4$ = 3.5-5
TDA $R^2$—O—$(EO)_{x1}$—H where $x_1$ = 5-10
TDA $R^2$—O—$(EO)_{x2}$—H where $x_2$ = 2-4
Plurafac SLF180 $R^7$—O—(PO)y5(EO)x5(PO)y6 where R is C and $x_5$ = 9-22, $y_5$ = 1-4, $y_6$ = 10-20
Lutensol XL $R^6$—O—(PO)y4(EO)x4 where R is $C_8$—$C_{16}$-guerbet, $x_4$ = 3-8, $y_4$ = 1-8

One benefit of use of the extended nonionic surfactants of the invention is the extremely low level of un-reacted alcohol, as compared to the non-extended ones, as shown in the following two tables.

TABLE 7

% unreacted alcohols in NPE's and AE's:

| | Approximate % unreacted alcohols from literature |
|---|---|
| NPE 9.5 | <1 |
| NPE 6.5 | <1 |
| Linear C12-C16 alcohol 7 moles EO | 6 |
| Alcohol C12-14 alcohol 3 moles EO | 25 |

TABLE 8

% unreacted alcohols in more recently developed ethoxylates:

| | Approximate % unreacted alcohols |
|---|---|
| BASF Lutensol XP-50 (C10 Guerbet alcohol, 5 mole ethoxylate) | 8 |
| BASF Lutensol XP-70 (C10 Guerbet alcohol, 7 mole ethoxylate) | 3.5 |
| BASF Lutensol XL-50 (C10 Guerbet alcohol, 1-1.5 mole PO, 5 moles EO) | 2.5 |
| BASF Lutensol XL-70 (C10 Guerbet alcohol, 1-1.5 mole PO, 7 moles EO) | 1 |
| BASF Plurafac SL-42 (C6-10 alcohol, 3 moles PO, 6 moles EO) | 0.06 |

TABLE 8-continued

| % unreacted alcohols in more recently developed ethoxylates: | |
|---|---|
| | Approximate % unreacted alcohols |
| BASF Plurafac SL-62 (C6-10 alcohol, 3 moles PO, 8 moles EO) | <0.1 |
| Dow Ecosurf EH and SA series | Very low odor. Expected to be <0.1 |
| Akzo Nobel Ethylan 1005 (narrow range ethoxylate based on C10 Guerbet alcohol) | <2.5 |
| Akzo Nobel Berol 260 and 266 (narrow range ethoxylate based on C9-11 alcohol) | <1 |
| Akzo Nobel Berol 840 (narrow range ethoxylate based on branched C8 alcohol) | 0.2% max. |
| Sasol narrow range isodecyl alcohol 7 moles EO | 2 |
| Sasol narrow range FT-Oxo alcohol 9 mole EO | 0.5 |
| Sasol narrow range linear alcohol 7 mole EO | 0.5 |

Figure 7:
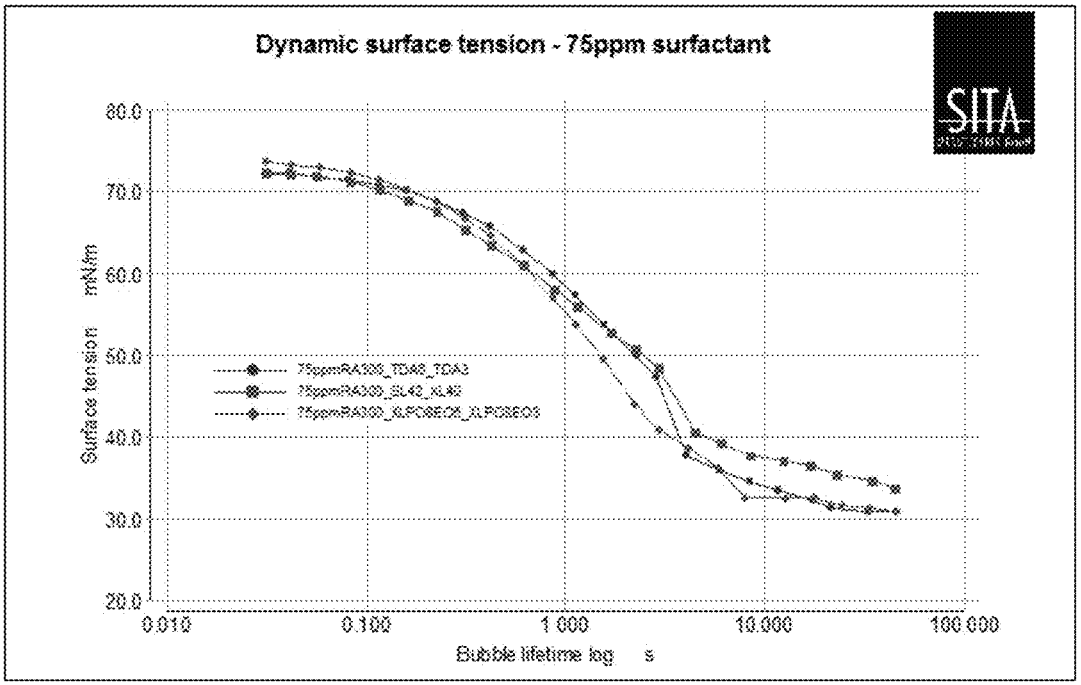
FIG. 7 Dynamic surface tension comparison of surfactant packages with RA300. Pairing RA300 with tridecyl alcohol ethoxylates versus low odor extended chain nonionic surfactants.

FIG. 7 shows the dynamic surface tension comparison of surfactant packages with RA300. Pairing RA300 with tridecyl alcohol ethoxylates versus low odor extended chain nonionic surfactants.

TABLE 9

Plurafac RA 300 sheeting test. Looking at complete sheeting (x) on 11 substrates in the institutional market.
Product Plurafac RA 300 L# 11195580
Water Type 0 grain

| | ppm, Actives in Rinse Aid | | | | | | | |
|---|---|---|---|---|---|---|---|---|
| | 40 | 50 | 60 | 70 | 80 | 90 | 100 | 110 |
| Glass tumbler | — | — | — | 1 | 1 | X | X | X |
| China Plate | 1 | 1 | 1 | 1 | X | X | X | X |
| Melamine Plate | 1 | 1 | 1 | 1 | X | X | X | X |
| Polypropylene Cup (yellow) | — | — | — | — | — | 1 | 1 | X |
| Dinex Bowl (blue) | — | — | — | — | — | 1 | 1 | X |
| Polypropylene Jug (blue) | — | — | 1 | 1 | 1 | X | X | X |
| Polysulfonate Dish (clear tan) | — | — | 1 | 1 | 1 | X | X | X |
| Stainless Steel Knife | — | 1 | 1 | 1 | 1 | X | X | X |
| Polypropylene tray (peach) | 1 | 1 | 1 | 1 | 1 | X | X | X |
| Fiberglass tray (tan) | — | — | 1 | 1 | 1 | X | X | X |
| Stainless steel slide 316 | 1 | 1 | 1 | 1 | 1 | X | X | X |
| Temperature, ° F. | 157 | 157 | 157 | 157 | 157 | 157 | 157 | 157 |
| Suds | None | None | None | None | None | None | None | None |

TABLE 10

Plurafac RA 300/TDA6/TDA3 sheeting test. Looking at complete sheeting (x) on 11 substrates in the institutional market.

| Product<br>Water Type | 40% RA300/40% TDA6/20% TDA3<br>0 grain | | | | |
|---|---|---|---|---|---|
| ppm, Actives in Rinse Aid | 10 | 20 | 30 | 40 | 50 |
| GLASS TUMBLER | — | 1 | X | X | X |
| China Plate | — | — | 1 | 1 | X |
| Melamine Plate | — | 1 | 1 | X | X |
| Polypropylene Cup (yellow) | — | — | 1 | 1 | X |
| Dinex Bowl (blue) | — | — | 1 | 1 | X |
| Polypropylene Jug (blue) | — | — | 1 | 1 | X |
| Polysulfonate Dish (clear tan) | — | — | 1 | 1 | X |
| Stainless Steel Knife | — | — | 1 | 1 | X |

TABLE 10-continued

Plurafac RA 300/TDA6/TDA3 sheeting test. Looking at complete sheeting (x) on 11 substrates in the institutional market.

| Product<br>Water Type | 40% RA300/40% TDA6/20% TDA3<br>0 grain | | | | |
|---|---|---|---|---|---|
| ppm, Actives in Rinse Aid | 10 | 20 | 30 | 40 | 50 |
| Polypropylene tray (peach) | — | — | 1 | 1 | X |
| Fiberglass tray (tan) | — | — | — | 1 | X |
| Stainless steel slide 316 | — | 1 | 1 | X | X |
| Temperature, ° F. | 150 | 150 | 150 | 150 | 150 |
| Suds | 0.25" stable foam | | | | |

TABLE 11

Plurafac RA 300/SL42/Lutensol XL40 sheeting test. Looking at complete sheeting (x) on 11 substrates in the institutional market.
Product 40% RA300/40% Plurafac SL-42/20% Lutensol XL-40
Water Type 0 grain

| | ppm, Actives in Rinse Aid | | | | |
|---|---|---|---|---|---|
| | 10 | 20 | 30 | 40 | 50 |
| Glass tumbler | — | — | — | 1 | X |
| China Plate | — | — | 1 | 1 | X |
| Melamine Plate | — | 1 | 1 | X | X |

TABLE 11-continued

Plurafac RA 300/SL42/Lutensol XL40 sheeting test. Looking at complete sheeting (x) on 11 substrates in the institutional market.
Product 40% RA300/40% Plurafac SL-42/20% Lutensol XL-40
Water Type 0 grain

| | ppm, Actives in Rinse Aid | | | | |
|---|---|---|---|---|---|
| | 10 | 20 | 30 | 40 | 50 |
| Polypropylene Cup (yellow) | — | — | — | 1 | X |
| Dinex Bowl (blue) | — | — | — | 1 | X |
| Polypropylene Jug (blue) | — | — | — | 1 | X |
| Polysulfonate Dish (clear tan) | — | — | — | 1 | X |

TABLE 11-continued

Plurafac RA 300/SL42/Lutensol XL40 sheeting test. Looking at complete sheeting (x) on 11 substrates in the institutional market. Product 40% RA300/40% Plurafac SL-42/20% Lutensol XL-40 Water Type 0 grain

| | ppm, Actives in Rinse Aid | | | | |
|---|---|---|---|---|---|
| | 10 | 20 | 30 | 40 | 50 |
| Stainless Steel Knife | — | — | 1 | 1 | X |
| Polypropylene tray (peach) | — | — | 1 | 1 | X |
| Fiberglass tray (tan) | — | — | 1 | 1 | X |
| Stainless steel slide 316 | — | 1 | 1 | X | X |
| Temperature, ° F. | 155 | 155 | 155 | 155 | 155 |
| Suds | 0.25" stable foam | | | | |

The formulation with extended surfactants has no residual alcohol odor in concentrate and use solutions (when machine is opened to extract ware, no alcohol odor). Formulations with extended surfactants drastically reduce unreacted alcohol, enhancing their microemulsification properties vs. oily soils and better defoaming properties, and eliminate chance of smoking and odor issues in certain applications.

TABLE 12

Plurafac RA 300/SL42/Lutensol XL40 foaming test observing surfactant foam profile and defoaming profile in the presence of 20 g powdered milk.

| Glewwe Defoam Evaluation with powdered milk | Materials Used |
|---|---|
| Glewwe foam Apparatus was set at 6 psi for 5 minutes at veried temperatures (° F.) | 3 L Soft Water |
| The Machine was then shut off and foam was measured for 1 minutes | 20 g Powdered milk (Favorite Brand) |
| Test run in soft water | 50 ppm active in the Glewwe |

| | Temp | Rinse Aid | Avtives | after 1 min run time (inches) | | | after 5 (total) minutes run time | | |
|---|---|---|---|---|---|---|---|---|---|
| Product | (° F.) | grams used | level | initial | 15 sec | 1 min | initial | 15 sec | 1 min |
| RA300/SL-42/XL-40 (40/40/20) | 120 | 0.15 | 100.0% | 2½ | 1 | ½ | 9 | 8½ | 8 |
| RA300/SL-42/XL-40 (40/40/20) | 140 | 0.15 | 100.0% | 1¼ | ⅛ | ⅛ | 8⅜ | 8 | 5¼ |
| RA300/SL-42/XL-40 (40/40/20) | 160 | 0.15 | 100.0% | 0 | 0 | 0 | 8⅜ | 7½ | 5⅜ |
| RA300/SL-42/XL-40/SLF-180 (32/32/16/20) | 120 | 0.15 | 100.0% | 1¼ | ⅛ | ⅛ | 5¾ | 2 | ¾ |
| RA300/SL-42/XL-40/SLF-180 (32/32/16/20) | 140 | 0.15 | 100.0% | 0 | 0 | 0 | 3½ | ¼ | ¼ |
| RA300/SL-42/XL-40/SLF-180 (32/32/16/20) | 160 | 0.15 | 100.0% | 0 | 0 | 0 | 5½ | ½ | ⅜ |

Summary

Biodegradable rinse aid compositions providing excellent sheeting and degreasing properties, and low un-reacted alcohol (and thus low odor) comprising:

Extended nonionic surfactants chosen from the Plurafac SL series, the Ecosurf SA series, and the Ecosurf EH series.

Optionally extended non-ionic surfactants chosen from the Lutensol XL-series, or the lower EO members of the Ecosurf SA series and Ecosurf EH-series for overall cloud point lowering.

Optionally an association disruption agents represented by alcohol (EO)x(PO)y

Optionally a defoamer for foam due to protein soil, such as Plurafac SLF-180, or Pluronic 25R2.

Optimally, the PO extension in the Plurafac SL series and the Ecosurf SA series be increased to 5-8 moles.

These compositions are also excellent compositions for machine warewashing and CIP cleaning.

What is claimed is:

1. A cleaning composition/rinse aid capable of forming microemulsions comprising:

an extended chain nonionic surfactant of the following formula:

$$R—[PO]_x\text{-}[EO]_y$$

where R is linear or branched, saturated or unsaturated, substituted or unsubstituted aliphatic or aromatic hydrocarbon radical have from about 8 to 20 carbon atoms, a tridecyl or Guerbet alcohol, x is 4-8; y is the average degree of ethoxylation ranging from 2 to 20, wherein the cleaning composition/rinse aid forms the microemulsion without the need for linker or other cosurfactants.

2. The composition of claim 1 wherein x is from about 5 to about 8.

3. The composition of claim 1 wherein said R is a Guerbet alcohol.

4. The composition of claim 3 wherein R is 4 to 14 carbon atoms.

5. The composition of claim 1 wherein said nonionic surfactant has the formula:

$$R—[PO]_x\text{-}[EO]_y—N$$

wherein N is $PO_z$, where z is 1-5, or an alkyl group.

6. The composition of claim 5 wherein said alkyl group is methyl, ethyl, propyl, butyl, or benzyl.

7. The composition of claim 3 wherein x is 8 and y is 3, 6, 8, or 10.

8. A method of cleaning, including rinsing, removing protein, and/or non-transfats through the formation of an emulsion or micro emulsion comprising:

applying to a surface having said protein or non-transfat, a cleaning composition/rinse aid comprising a nonionic extended chain nonionic surfactant so that a micro emulsion is formed, wherein the cleaning composition/rinse aid forms the microemulsion without the need for linker or other cosurfactants, and rinsing or wiping said surface so that said surfactant and protein or non-transfat are removed.

9. The method of claim 8 wherein said extended chain nonionic surfactant has the following formula:

$$R\text{-}[L]_x\text{-}[O—CH_2—CH_2]_y$$

where R is a linear or branched, saturated or unsaturated, substituted or unsubstituted, aliphatic or aromatic hydrocarbon radical having from about 8 to 20 carbon atoms, L is a $PO_z$ linking group z is 5-8, x is the chain length of the linking group ranging from 2-25, and y is the average degree of ethoxylation ranging from 2 to 20.

10. The method of claim 9 wherein R is C10 Guerbet, y is 3 and said micro emulsion is formed at a temperature of 80° to 90° F.

11. The method of claim 9 wherein R is C10 Guerbet y is 6 and said micro emulsion is formed at a temperature of from about 120° to about 160° F.

12. The method of claim 9 wherein R is C10 Guerbet y is 8 and said micro emulsion is formed at a temperature of from about 150° to about 185° F.

13. The method of claim 9 wherein R is C10 Guerbet y is 10 and said micro emulsion is formed at a temperature of from about 165° to about 190° F.

14. The method of claim 9 wherein said extended chain nonionic surfactant is capped with from 1-5 PO groups.

15. The method of claim 9 wherein said extended chain nonionic surfactant is capped with a benzyl group.

16. The method of claim 9 wherein said extended chain nonionic surfactant includes one or more of the following: $C_{6-10}(PO)_3(EO)_6$;$C_{6-10}(PO)_3(EO)_8$; (3 propyl heptanol Guerbet alcohol- C10-(PO)a(EO)b where a is 1.0 to 1.5, and b is 4 to 14; Guerbet alcohol); $(PO)_8(EO)_3$;Guerbet alcohol $(PO)_8(EO)_6$;Guerbet alcohol $(PO)_8(EO)_8$;Guerbet alcohol $(PO)_8(EO)_{10}$; 2-Ethyl Hexyl (PO)m(EO)n (where m is less than 5 and n is 5-8); $C_{6-12}$ $(PO)_{3-4}$ $(EO)_4$; $C_{6-12}$ $(PO)_{3-4}$ $(EO)_7$; $C_{6-12}$ $(PO)_{3-4}$ $(EO)_9$; $C_{12-14}(PO)_2N[(EO)_{2.5})_2$; $C_{12-14}$ $(PO)_{16}(EO)_6$; $C_{12-14}(PO)_{16}(EO)_{12}$; $C_{12-14}(PO)_{16}(EO)_{17}$; $C_{16-18}(PO)_4(EO)_5$-carboxylic acid; $C_{16-18}(PO)_4(EO)_2$-carboxylic acid; Iso $C_9(PO)_2EO_2$-carboxylic acid; Tridecyl alcohol (TDA)-$(PO)_4$; TDA-$(PO)_4(EO)_8$; TDA-$(PO)_4$ $(EO)_{10}$; TDA-$(PO)_4(EO)_{12}$; TDA-$(PO)_4(EO)_{14}$; TDA-$(PO)_4(EO)_{18}$; $C_{12-14}$—$(PO)_4$; $C_{12-14}(PO)_6$; $C_{12-14}(PO)_8$; $C_{12-14}(PO)_4(EO)_{12}$; $C_{12-14}$—$(PO)_4(EO)_{14}$; $C_{12-14}$—$(PO)_4$ $(EO)_{16}$; $C_{12-14}$—(PO)4$(EO)_{18}$; $C_{12-14}$—$(PO)_6(EO)_{14}$; $C_{12-14}$—$(PO)_6(EO)_{16}$; $C_{12-14}$—$(PO)_6(EO)_{18}$; $C_{12-14}$—$(PO)_6(EO)_{20}$; $C_{8-10}$—$(PO)_2(EO)_{11}$-Benzyl.

17. A cleaning composition including the surfactant of claim 10.

18. A cleaning composition including the surfactant of claim 11.

19. A cleaning composition including the surfactant of claim 12.

20. A cleaning composition including the surfactant of claim 13.

21. The cleaning composition of claim 17 wherein said cleaning composition is a hard surface cleaner or warewash detergent.

22. The cleaning composition of claim 18 wherein said cleaning composition is a hard surface cleaner or warewash detergent.

23. The cleaning composition of claim 19 wherein said cleaning composition is a hard surface cleaner or warewash detergent.

24. The cleaning composition of claim 20 wherein said cleaning composition is a hard surface cleaner or warewash detergent.

25. The method of claim 10 wherein said emulsion is essentially free of unreacted alcohols.

26. The method of claim 11 wherein said emulsion is essentially free of unreacted alcohols.

27. The method of claim 12 wherein said emulsion is essentially free of unreacted alcohols.

28. The method of claim 13 wherein said emulsion is essentially free of unreacted alcohols.

29. A rinse aid comprising the following:

(a) a sheeting agent;

(b) a defoaming agent; and (c) an association disruption agent, wherein at least one of the (a), (b), or (c) is an extended chain nonionic surfactant.

30. The rinse aid of claim 29 wherein said sheeting agent includes one or more of the following extended chain nonionic surfactants: $C_{6-10}$—$(PO)_3(EO)_6$, $C_{10}$—$(PO)_a(EO)_b$ a 2 propyl heptanol guerbet alcohol where a is 1-1.5 and b is 4-14), $C_{6-12}(PO)_{3-4}(EO)_7$, $C_{6-12}(PO)_{3-4}(EO)_3$, or a 2 ethylhexyl$(PO)_m(EO)_n$.

31. The rinse aid of claim 29 wherein said association disruption agent includes an nonionic surfactant of the formula:

$$R—O\text{-}(EO)_x(PO)_y—H$$

where R is $C_{10-16}$, x=5.5-7, and y=2-3.5.

32. The rinse aid of claim 29 wherein said rinse aid comprises an association disruption agent of a Compact EO/PO alcohol alkoxylate.

33. The rinse aid of claim 32 wherein the EO/PO alcohol alkoxylate includes a C12-C14 EO/PO alcohol alkoxylate.

34. The rinse aid of claim 29 wherein said defoaming agent includes an extended chain nonionic surfactant of the formula:

$$R—O—(PO)_y(EO)_x(PO)_z$$

where R is C; x=9-22, y=1-4 and z is =10-20.

35. A rinse aid comprising the following:

(a) a sheeting agent, wherein the sheeting agent comprises at least one compound having the structure represented by formula I: R—O—$(CH_2CH_2O)_n$—H wherein R is a $(C_1$-$C_{12})$ alkyl group, and n is an integer in the range of 1 to 100;

(b) a defoaming agent;

(c) an association disruption agent of an alcohol alkoxylate EO/BO surfactant, and/or a $C_{12}$-$C_{14}$ fatty alcohol EO/PO surfactant, and (d) an extended chain nonionic surfactant.

36. A rinse aid comprising a combination of extended chain nonionic surfactants having the following formulas:

$$R—O\text{-}(EO)_x(PO)_{y—H}$$

where R is $C_{10-16}$, x=5.5-7, and y=2-3.5;

$C_{6-10}$—$(PO)_3(EO)_6$; and $C_{10}$—$(PO)_a(EO)_b$: (a propyl heptanol guerbet alcohol where a is 1-1.5 and b is 4-14).

37. The rinse aid of claim 36 further comprising $$R—O—(PO)_y(EO)_x(PO)_z$$

where R is C; x=9-22, y=1-4 and z is =10-20.

38. The rinse aid of claim 36 wherein said $$R—O\text{-}(EO)_x(PO)_y—H$$

where R is $C_{10-16}$, x=5.5-7, and y=2-3.5 is present in an amount of from about 20 wt. % to about 60 wt. %: said $C_{6-10}$—$(PO)_3(EO)_6$ is present in an amount of from about 20 wt. % to about 60 wt. % and said $C_{10}$—$(PO)_a(EO)_b$ (a 2 propyl heptanol guerbet alcohol where a is 1-1.5 and b is 4-14) is present in an amount of form about 10 wt. % to about 30 wt. %.

39. The rinse aid of claim 38 wherein said $$R—O\text{-}(EO)_x(PO)_y—H$$

where R is $C_{10-16}$, x=5.5-7, and y=2-3.5 is present in an amount of about 40 wt. %;

said $C_{6-10}$—$(PO)_3(EO)_6$ is present in an amount of about 40%; and said $C_{10}$—$(PO)_a(EO)_b$ (a 2 propyl heptanol guerbet alcohol where a is 1-1.5 and b is 4-14) is present in an amount of about 20%.

40. The rinse aid of claim 39 further comprising:

$$R—O\text{-}(EO)_x(PO)_y—H$$

where R is $C_{10-16}$, x=5.5-7 and y=2-3.5; present in an amount of from about 25 wt. % to about 40 wt. %

$C_{6-10}$—$(PO)_3(EO)_6$ present in an amount of from about 25 wt. % to about 40 wt. % and $C_{10}$—$(PO)_a(EO)_b$ (a 2 propyl heptanol guerbet alcohol where a is 1-1.5 and b is 4-14) present in an amount of from about 5 wt. % to about 25 wt. % and $$R—O—(PO)_y(EO)_x(PO)_z$$

where R is C; x=9-22, y=1-4 and z is =10-20 10 wt. % to about 30 wt. %.

41. The rinse aid of claim 40 comprising:

$$R—O\text{-}(EO)_x(PO)_y—H$$

where R is $C_{10-16}$, x=5.5-7, and y=2-3.5; and is present in an amount of about 32 wt. %

$C_{6-10}$—$(PO)_3(EO)_6$ present in an amount of about 32% and $C_{10}$—$(PO)_a(EO)_b$ (a 2 propyl heptanol guerbet alcohol where a is 1-1.5 and b is 4-14) present in an amount of about 16%.

$$R—O—(PO)_y(EO)_x(PO)_z$$

where R is C; x=9-22, y=1-4 and z is =10-20 present in an amount of about 20%.

* * * * *